US006076359A

United States Patent [19]

Jurcik et al.

[11] Patent Number: 6,076,359

[45] **Date of Patent: *Jun. 20, 2000**

[54] SYSTEM AND METHOD FOR CONTROLLED DELIVERY OF LIQUIFIED GASES

[75] Inventors: Benjamin Jurcik, Lisle; Richard Udischas, Chicago; Hwa-Chi Wang, Naperville, all of Ill.

[73] Assignee: American Air Liquide Inc., Walnut Creek, Calif.

[ * ] Notice: This patent is subject to a terminal disclaimer.

[21] Appl. No.: 08/893,499

[22] Filed: Jul. 11, 1997

Related U.S. Application Data

[63] Continuation-in-part of application No. 08/753,413, Nov. 25, 1996, Pat. No. 5,761,911.

[51] Int. Cl.[7] ..... F17C 9/02

[52] U.S. Cl. ..... 62/50.2; 62/49.1; 219/201; 219/521; 392/490

[58] Field of Search ..... 62/49.1, 77, 149, 62/50.2; 392/490; 219/201, 521

[56] References Cited

U.S. PATENT DOCUMENTS

| | | |
|---|---|---|
| 2,842,942 | 7/1958 | Johnston et al. . |
| 3,282,305 | 11/1966 | Antolak . |

(List continued on next page.)

FOREIGN PATENT DOCUMENTS

| | | |
|---|---|---|
| 0 052 351 | 11/1981 | European Pat. Off. . |
| 0 802 363 | 10/1997 | European Pat. Off. . |
| 2 443 017 | 11/1979 | France . |
| 2542421 | 9/1984 | France . |
| 3431 524 | 3/1986 | Germany . |
| 3530806 | 1/1987 | Germany . |
| 3709 189 | 9/1988 | Germany . |
| WO92/19923 | 11/1992 | WIPO . |

OTHER PUBLICATIONS

Peterson et al, "Vaporizer System Smoothens Flow from Gas Cylinders," *Chemical Engineering*, vol. 93, No. 18, Sep. 29, 1986.

European Search Report issued in EP 97 40 2751.

P. Bhadha et al, Joule–Thompson Expansion and Corrosion in HC1 System, Solid State Technology, Jul. 1992, pp. 53–57.

S. Fine et al, "Using Organosilanes to Inhibit Adsorption in Gas Delivery Systems," Solid State Technology, Apr. 1996, pp. 93–97.

S. Fine et al, "Optimizing the UHP Gas Distribution System for a Plasma Etch Tool," Solid State Technology, Mar. 1996, pp. 71–81.

S. Fine et al, "Design and Operation of UHP Low Vapor Pressure and Reactive Gas Delivery Systems," Semiconductor International, Oct. 1995, pp. 138–146.

N. Chowdhury et al, "Developing a Bulk Distribution System for High–Purity Hydrogen Chloride," Micro, Sep. 1995, pp. 33–37.

*Primary Examiner*—Ronald Capossela

*Attorney, Agent, or Firm*—Burns, Doane, Swecker & Mathis, L.L.P.

[57] ABSTRACT

Provided is a novel system and method for delivery of a gas from a liquified state. The system includes: (a) a compressed liquified gas cylinder having a gas line connected thereto through which the gas is withdrawn; (b) a gas cylinder cabinet in which the gas cylinder is housed; and (c) means for increasing the heat transfer rate between ambient and the gas cylinder without increasing the temperature of the liquid in the gas cylinder above ambient temperature. The apparatus and method allow for the controlled delivery of liquified gases from gas cabinets at high flowrates. Particular applicability is found in the delivery of gases to semiconductor process tools.

47 Claims, 18 Drawing Sheets

U.S. PATENT DOCUMENTS 3,648,018 3/1972 Cheng et al. .
3,827,246 8/1974 Moen et al. .
3,939,871 2/1976 Dickson .
4,219,725 8/1980 Groninger .
4,693,252 9/1987 Thoma et al. .
4,762,428 8/1988 Villiger .
4,989,160 1/1991 Garrett et al. .
5,117,639 6/1992 Take .
5,152,318 10/1992 Ortner et al. .
5,249,434 10/1993 Abraham .
5,252,134 10/1993 Stauffer .
5,279,129 1/1994 Ito .
5,359,787 11/1994 Mostowy, Jr. et al. .
5,373,701 12/1994 Siefering et al. .
5,377,495 1/1995 Daigle .
5,413,139 5/1995 Kusumoto et al. .
5,426,944 6/1995 Li et al. .
5,440,477 8/1995 Rohrberg et al. .
5,478,534 12/1995 Louise et al. .
5,485,542 1/1996 Ericson .
5,531,245 7/1996 Sparks .
5,557,940 9/1996 Hendricks .
5,582,016 12/1996 Gier et al. .

FIG. 11A
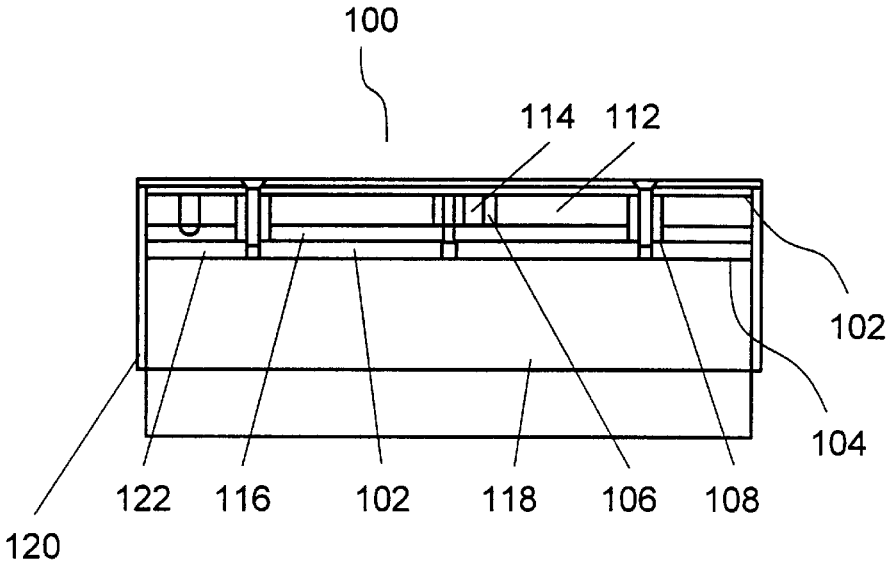
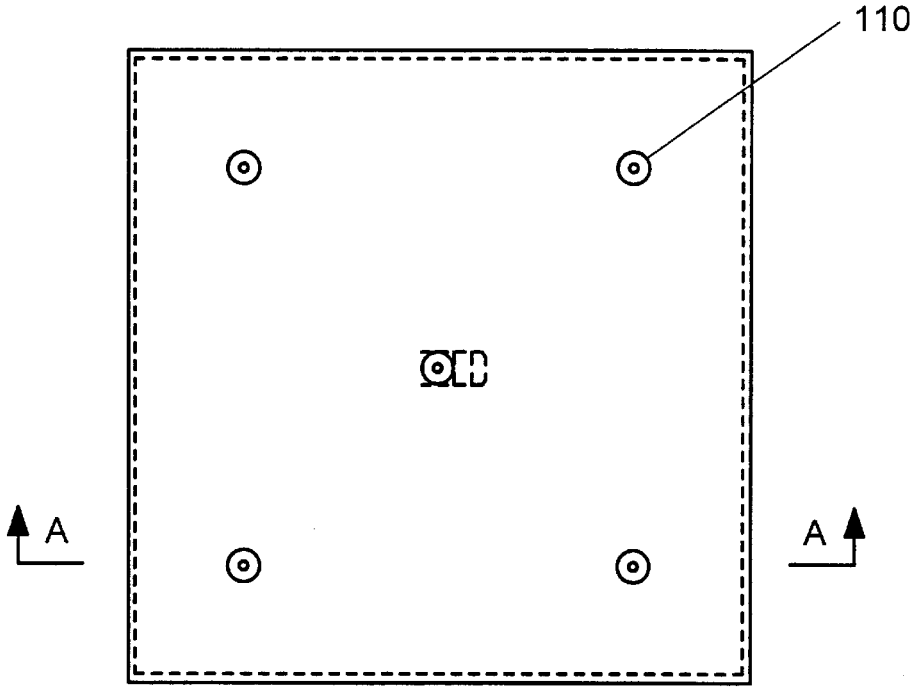
FIG. 11B

Effect of Superheater

FIG. 17

Control Algorithm for Heat Output to Liquid Vaporizer

Initialize sume = 0

Loop (until $M_p < (p_g/1000.0\ V*s)*2.2$)

$M_p = M-M_t$ (M = Mass reading from scale, $M_t$ = Tare weight)
($M_p$ = Mass of product in the cylinder)
[Dimensions all in lbs]

If $M_p < (p_g/1000.0\ V*s)*2.2$ ($p_g$ = the density of the gas vapor at room temperature and cylinder pressure [kg/m$^3$], look up table. V = the size of cylinder in liters, s = a safety factor, use 1.1 for the time being)

Output = 0

Else $T_{ldK}$ = (B/(ln(P)-A) The derived liquid temperature in [K] (P in psia)
$T_{ld} = 1.8*T_{ldK} - 460$ [Convert temperature to °F]
Error = $T_{sp} - T_{ld}$
sume = sume + Error*dt (dt about 0.1 - 10s)
If Error < 0
Output = 0; sume = 0
Else
$K_c = T_{gain}*M$ ($T_{gain}$ ~30, [$K_c$]=W/F)
Output = $K_c$*Error+$K_c$/tau*sume Endif
Endif
Fraction on = Output/Maxoutput (Maxoutput = 300W)
Endloop

SYSTEM AND METHOD FOR CONTROLLED DELIVERY OF LIQUIFIED GASES

CROSS REFERENCE TO RELATED APPLICATIONS

This application is a continuation-in-part of application Ser. No. 08/753,413, filed on Nov. 25, 1996, now U.S. Pat. No. 5,761,911, which application is herein incorporated by reference.

BACKGROUND OF THE INVENTION

1. Field of the Invention

The present invention relates to a system for controlled delivery of a gas from a liquified state, and to a semiconductor processing system comprising the same. The present invention also relates to a method for controlled delivery of a gas from a liquified state.

2. Description of the Related Art

In the semiconductor manufacturing industry, high purity gases stored in cylinders are supplied to process tools for carrying out various semiconductor fabrication processes. Examples of such processes include diffusion, chemical vapor deposition (CVD), etching, sputtering and ion implantation. The gas cylinders are typically housed within gas cabinets. These gas cabinets also contain means for safely connecting the cylinders to respective process gas lines via a manifold. The process gas lines provide a conduit for the gases to be introduced to the various process tools.

Of the numerous gases utilized in the semiconductor manufacturing processes, many are stored in cylinders in a liquified state. A partial list of chemicals stored in this manner, and the pressures under which they are stored, is provided below in Table 1:

TABLE 1

| Chemical | Formula | Vapor Pressure of Gas at 20° C. (psia) |
|---|---|---|
| Ammonia | $NH_3$ | 129 |
| Arsine | $AsH_3$ | 220 |
| Boron Trichloride | $BCl_3$ | 19 |
| Carbon Dioxide | $CO_2$ | 845 |
| Chlorine | $Cl_2$ | 100 |
| Dichlorosilane | $SiH_2Cl_2$ | 24 |
| Disilane | $Si_2H_6$ | 48 |
| Hydrogen Bromide | HBr | 335 |
| Hydrogen Chloride | HCl | 628 |
| Hydrogen Fluoride | HF | 16 |
| Nitrous Oxide | $N_2O$ | 760 |
| Perfluoropropane | $C_3F_8$ | 115 |
| Sulfur Hexafluoride | $SF_6$ | 335 |
| Phosphine | $PH_3$ | 607 |
| Tungsten Hexafluoride | $WF_6$ | 16 |

The primary purpose of the gas cabinet is to provide a safe vehicle for delivering one or more gases from the cylinder to the process tool. The gas cabinet typically includes a gas panel with various flow control devices, valves, etc., in a configuration allowing cylinder changes and/or component replacement in a safe manner.

The cabinets conventionally include a system for purging the gas delivery system with an inert gas (e.g., nitrogen or argon) before breaking any seals. Control and automation of purging operations are known in the art, and are disclosed, for example, in U.S. Pat. No. 4,989,160, to Garrett et al. This patent indicates that different purging procedures are required for different types of gases, but does not recognize any special concerns with respect to liquified gas cylinders.

In the case of HCl, condensation occurs by the Joule-Thompson effect (see, *Joule-Thompson Expansion and Corrosion in HCl System,* Solid State Technology, July 1992, pp. 53–57). Liquid HCl is more corrosive than its vapor form. Likewise, for the majority of chemicals listed above in Table 1, the liquid forms thereof are more corrosive than their respective vapor forms. This is due to impurities, such as moisture, which are trapped in the liquid phase and which exist at surfaces of the gas distribution system. Thus, condensation of these materials in the gas delivery system can lead to corrosion, which is harmful to the components of the system. Furthermore, the corrosion products can lead to contamination of the highly pure process gases. This contamination can have deleterious effects on the processes being run, and ultimately on the manufactured semiconductor devices.

The presence of liquid in the gas delivery system has also been determined to lead to inaccuracies in flow control. That is, the accumulation of liquid in various flow control devices can cause flowrate and pressure control problems as well as component failure, leading to misprocessing. One example of such behavior is the swelling of a valve seat by liquid chlorine, which causes the valve to become permanently closed.

In typical gas delivery systems, the first component through which the gas passes after leaving the cylinder is a pressure reduction device, such as a pressure regulator or orifice. However, for cylinders containing materials with relatively low vapor pressures (e.g., $WF_6$, $BCl_3$, HF and $SiH_2Cl_2$), a regulator may not be suitable, in which case the first component can be a valve. These regulators or valves often fail during service and require replacement. The failure of such components can often be attributed to the presence of liquid in the components. Such failure can necessitate shutdown of the process during replacement of the failed parts and subsequent leak checking. Extensive process downtime can result.

In U.S. Pat. No. 5,359,787, to Mostowy, Jr. et al, an apparatus is described for the delivery of hygroscopic, corrosive chemicals such as HCl from a bulk source (e.g., a tube trailer) to a point of use. This patent discloses use of an inert gas purge and vacuum cycle, and a heated purifier downstream of the bulk storage container. By heating during pressure reduction, condensation of the corrosive gas is prevented in the delivery line. U.S. Pat. No. 5,359,787 is directed to bulk storage systems in which the volumes of stored chemicals are substantially larger than the volumes typical of cylinders stored in gas cabinets. As a result of the large volumes associated with bulk storage systems, temperature and pressure within bulk storage containers are generally constant until the liquid in the container becomes substantially depleted. Pressure in such containers is primarily controlled by seasonal variations in the ambient temperature.

In contrast, variations in pressure of the comparatively low volume cylinders stored in gas cabinets depend upon the rate of gas withdrawal from the cylinder (and the removal of the necessary heat of vaporization) as well as the transfer of ambient energy to the cylinder. Such effects are not typically present in bulk storage systems. In bulk storage systems, the thermal mass of the stored chemical is sufficiently large that liquid temperature variation occurs relatively slowly. Gas pressure in bulk systems is controlled by the temperature of the liquid. That is, the pressure inside the container is equal to the vapor pressure of the chemical at the temperature of the liquid contained therein. In gas delivery systems based on cylinders, the need to control cylinder pressure by controlling liquid temperature vis-a-vis cylinder temperature is recognized in the art. Gas cylinder heating/cooling jackets have been proposed for controlling cylinder pressure through the control of cylinder temperature. In such a case, a heating/cooling jacket can be placed in intimate contact with the gas cylinder. The jacket is maintained at a constant temperature by a circulating fluid, the temperature of which is controlled by an external heater/chiller unit. Such heating/cooling jackets are commercially available, for example, from Accurate Gas Control Systems, Inc.

These heating/cooling jackets are typically used for controlling the temperature of thermally unstable gases, such as diborane ($B_2H_6$). Another use for the heating/cooling jackets is in the heating of cylinders containing low vapor pressure gases such as $BCl_3$, $WF_6$, HF and $SiH_2Cl_2$. Because the cylinder pressure for these gases is low, any further decrease in pressure due to a lowering of the liquid temperature can create flow control problems.

Control of cylinder temperature coupled with thermal regulation of the entire gas piping system to prevent recondensation in the gas delivery system has also been proposed for gases having low vapor pressures. The requirement for thermal regulation of the piping system is a result of the greater than ambient temperature of the cylinder caused by the heating/cooling jacket. If the gas line is not thermally controlled, recondensation of the gas flowing therethrough can occur when it passes from the heated zone into a lower temperature zone. Heating/cooling jackets coupled with thermal regulation is not favored, however, due to the complications associated with system maintenance (e.g., during cylinder replacement) and the added expense. In addition, heating/cooling jackets have great potential for overheating since the jackets are wrapped around the cylinder, since the entire system is heated and brought to the heating temperature. Such overheating can result in recondensation in the gas distribution system downstream of the cylinder, resulting from the lower temperatures. As a result, heating of the entire distribution system from the gas cylinder to the point-of-use becomes necessary to prevent such recondensation.

Moreover, cylinder heating/cooling jackets are not thermally efficient. For example, typical cylinder heating/cooling jackets have heating and cooling capabilities of about 1500 W. Table 2 summarizes the energy requirements for the continuous vaporization of various gases at flowrates of 10 slm from a cylinder. This data demonstrates that the energy requirements for vaporization are substantially less than the heating/cooling ratings of the cylinder jackets.

TABLE 2

| Chemical | Energy required for 10 slm (W) | Chemical | Energy required for 10 slm (W) |
|---|---|---|---|
| Ammonia | 133.8 | Hydrogen Chloride | 61.8 |
| Arsine | 115.1 | Hydrogen Fluoride | 60 |
| Boron Trichloride | 156.4 | Nitrous Oxide | 55.7 |
| Chlorine | 122.4 | Perfluoropropane | 111.5 |
| Dichlorosilane | 153.2 | Sulfur Hexafluoride | 107.7 |
| Hydrogen Bromide | 85.7 | Tungsten Hexafluoride | 179 |

The above described disadvantages associated with the use of heating/cooling jackets and strict thermal regulation of gas distribution systems make use thereof undesirable.

To meet the requirements of the semiconductor processing industry and to overcome the disadvantages of the related art, it is an object of the present invention to provide a novel system for controlled delivery of gases from a liquified state which will allow for accurate control of the pressure in cylinders containing liquified gases, while simultaneously minimizing entrained droplets in the gases withdrawn from the cylinders. Thus, single phase process gas flow can be obtained with a substantially increased flowrate. As a result, a number of process tools can be serviced by a single gas cabinet. Alternatively, a higher flowrate can be delivered to an individual process tool. Moreover, use of cumbersome heating/cooling jackets and strict thermal management of the process line can be avoided.

It is a further object of the present invention to provide a semiconductor processing system which comprises the inventive system for controlled delivery of gases from a liquified state.

It is a further object of the present invention to provide a method for controlled delivery of gases from a liquified state.

It is a further object of the present invention to provide a heated valve for regulating the flow of a gas, which can be used in conjunction with the inventive system and method.

It is a further object of the present invention to provide a heated scale cover which can be used in the inventive system and method.

Other objects and aspects of the present invention will become apparent to one of ordinary skill in the art upon review of the specification, drawings and claims appended hereto.

SUMMARY OF THE INVENTION

The foregoing objectives are met by the system and method of the present invention. According to a first aspect of the present invention, a novel system for delivery of a gas from a liquified state is provided. The system comprises: (a) a compressed liquified gas cylinder having a gas line connected thereto through which the gas is withdrawn; (b) a gas cylinder cabinet in which the gas cylinder is housed; and (c) means for increasing the heat transfer rate between the ambient and the cylinder without increasing the temperature of the liquid in the gas cylinder above ambient temperature.

According to a second aspect of the invention, a semiconductor processing system is provided. The system comprises a semiconductor processing apparatus and the inventive system for delivery of a gas from a liquified state.

A third aspect of the invention is a method for delivery of a gas from a liquified state. The method comprises: (a) providing a compressed liquified gas in a gas cylinder having a gas line connected thereto, the gas cylinder being housed in a gas cylinder cabinet; and (b) increasing the heat transfer rate between the ambient and the gas cylinder without increasing the temperature of the liquid in the gas cylinder above the ambient temperature.

BRIEF DESCRIPTION OF THE DRAWINGS

The objects and advantages of the invention will become apparent from the following detailed description of the preferred embodiments thereof in connection with the accompanying drawings, in which:

FIGS. 11A and B illustrate side-sectional and top view, respectively, of a gas cylinder heater in accordance with the invention;

FIG. 17 illustrates a control algorithm for controlling a heater in accordance with one aspect of the invention.

DETAILED DESCRIPTION OF THE PREFERRED EMBODIMENTS OF THE INVENTION

The invention provides an effective way to control pressure in a cylinder without using a cylinder heating/cooling jacket, while simultaneously minimizing entrained droplets in a gas withdrawn from the cylinder. Single phase flow is thereby ensured.

It has surprisingly and unexpectedly been determined that an increase in the heat transfer rate between the ambient and a gas cylinder, which decreases the temperature difference between the ambient and the cylinder, does not require the same strict thermal regulation required in a gas line when a cylinder heating/cooling jacket is used. Such strict regulation is not required because the cylinder temperature is not increased with the increased heat transfer rate.

As used herein, the term "ambient" refers to the atmosphere surrounding the gas cylinder.

To illustrate how entrained droplets can be found in process gases during normal cylinder use, the thermal changes in a cylinder are described below with reference to FIGS. 1 and 2.

Figure 1:
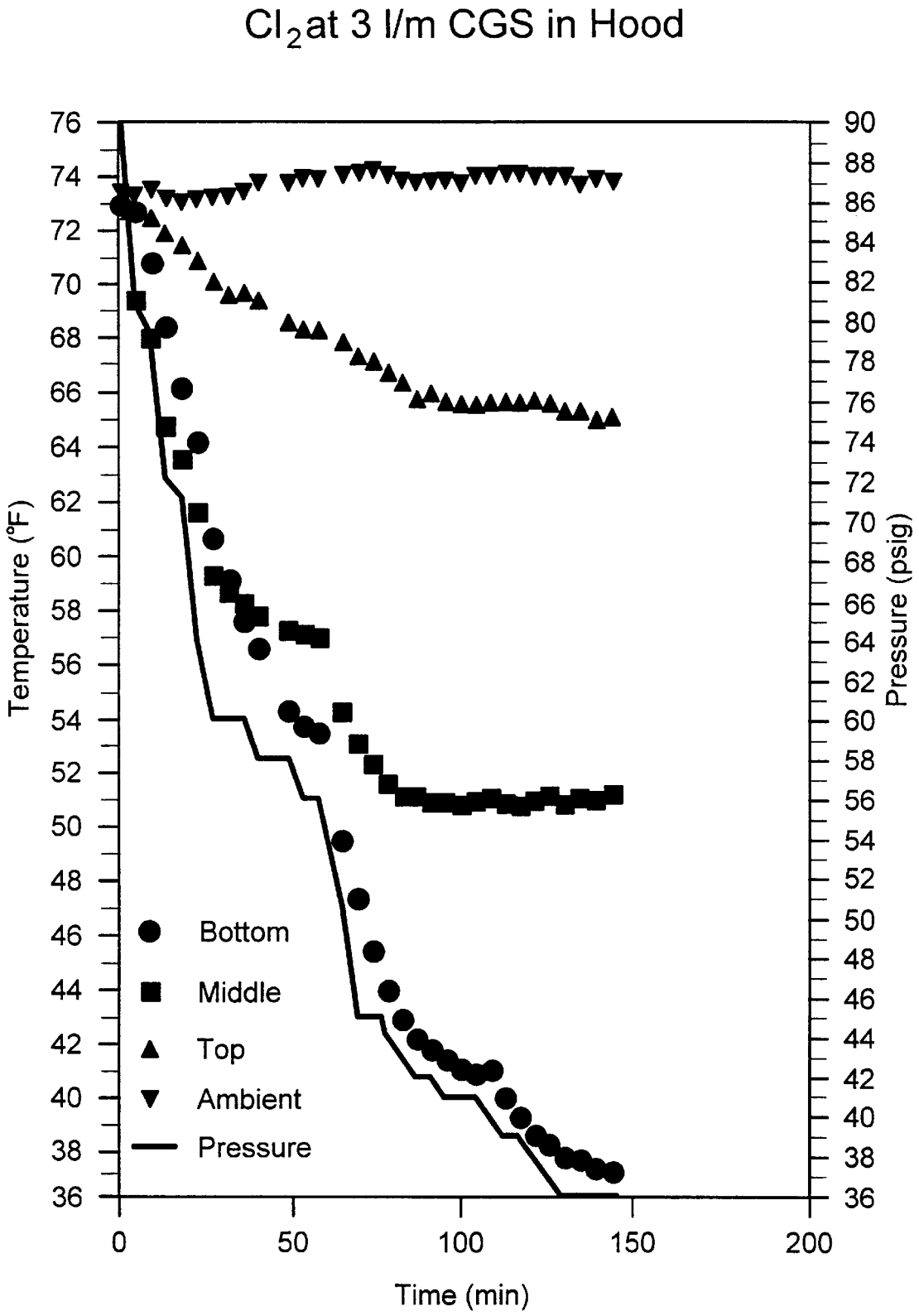
FIG. 1 is a graph that depicts external cylinder wall temperature measured at various locations along the cylinder, and vapor pressure in the cylinder as functions of time for a $Cl_2$ cylinder.
Figure 2:
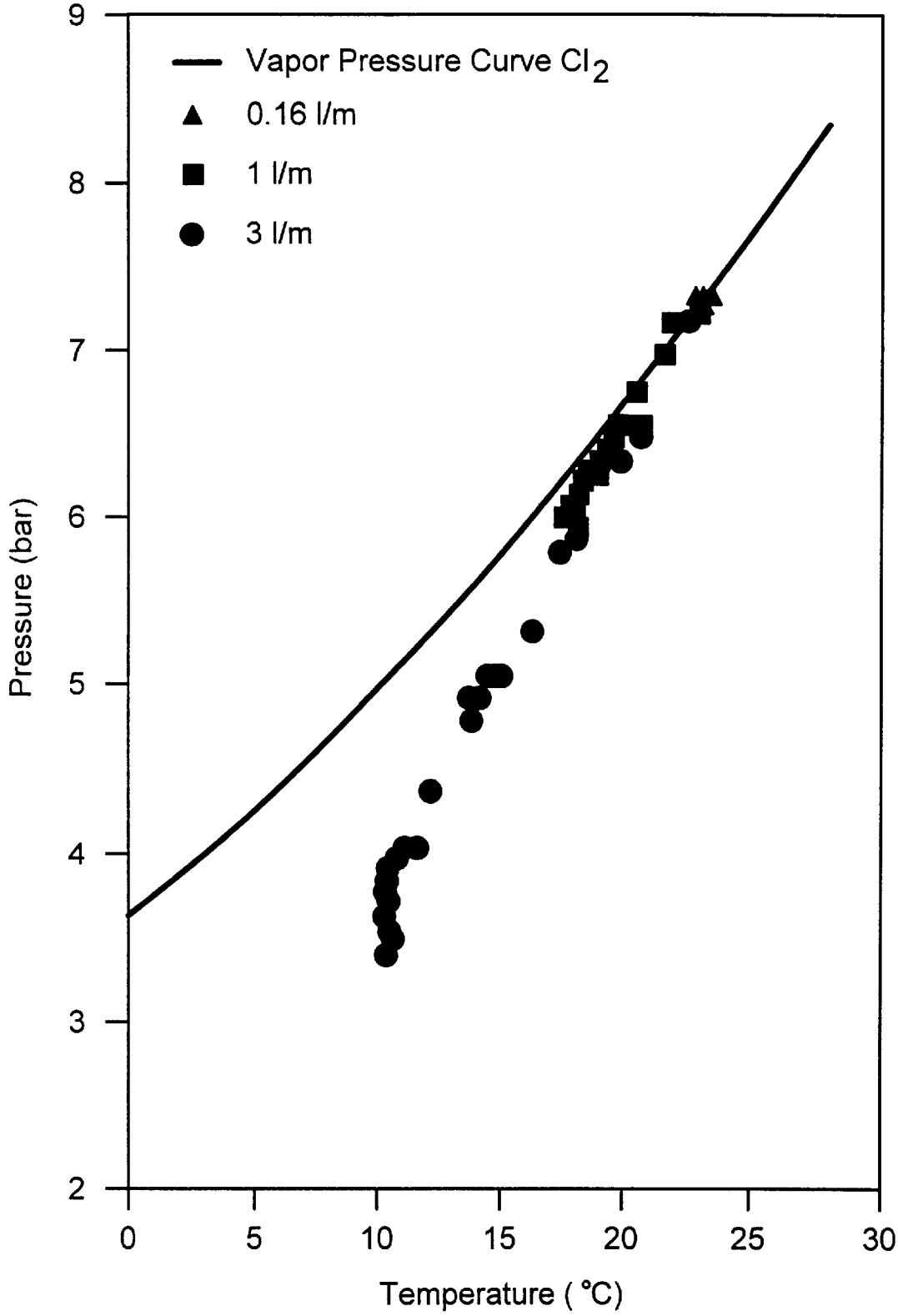
FIG. 2 is a graph that depicts vapor pressure in a cylinder as a function of liquid temperature in the cylinder, and theoretical vapor pressure corresponding to the coldest external cylinder temperature for various flow rates.

FIG. 1 illustrates external cylinder wall temperature as a function of time at several locations on a 7 l $Cl_2$ cylinder for a gas flowrate of 3 l/m. Vapor pressure in the cylinder as a function of time is also illustrated. During operation of the cylinder, the external cylinder temperature becomes substantially cooler than the ambient temperature. The coldest temperature on the cylinder surface corresponds to the location of the liquid-vapor interface since the vaporization process occurs in that region.

Based on the vapor pressure curve of $Cl_2$, the pressure inside the cylinder is indicative of a liquid temperature that is colder than the lowest external wall temperature. Such effect can be clearly seen in FIG. 2, which depicts vapor pressure of chlorine as a function of liquid temperature in the cylinder (solid line), and cylinder pressure as a function of measured external cylinder temperature for flowrates of 0.16, 1 and 3 l/m (individual points). Because the temperature of the liquid must be colder than the coldest external cylinder temperature, natural convection currents are induced. These natural convection currents help to homogenize the temperature in the liquid phase.

The rate of change of cylinder temperature and pressure is a balance of the rate of heat transfer to the cylinder, the energy requirements specified by the flowrate and the thermal mass of the cylinder. The rate of heat transfer between the ambient and the gas cylinder is governed by: (1) the overall heat transfer coefficient; (2) the surface area available for heat transfer; and (3) the temperature difference between the ambient and the gas cylinder. Approximating the gas cylinder as an infinitely long cylinder, the overall heat transfer coefficient is calculated by equation I, as follows:

$$U = \frac{1}{\frac{r_o}{r_i h_i} + \frac{r_o \ln(r_o / r_i)}{k} + \frac{1}{h_o}} \tag{I}$$

Wherein: U is the overall heat transfer coefficient ($W/m^2K$); $r_o$ is the external radius of the cylinder (m); $r_i$ is the internal radius of the cylinder (m); $h_i$ is the internal heat transfer coefficient between the cylinder and the liquid ($W/m^2K$); k is the thermal conductivity of the cylinder material ($W/m^2K$); and $h_o$ is the external heat transfer coefficient between the cylinder and the ambient ($W/m^2K$).

The overall heat transfer coefficient U is less than the smallest of the individual resistances to heat transfer (i.e., each term in the denominator of equation (I)). For conventionally used cylinder sizes (e.g., with internal volumes of 55

1 or less), the overall heat transfer coefficient is controlled primarily by the value of the external heat transfer coefficient $h_o$. This fact is demonstrated by the following example, in which: $r_i$=3 inches; $r_o$=3.2 inches; k=40 W/m$^2$K; $h_i$=890 W/m$^2$K; and $h_o$=4.5 W/m$^2$K. The values for the heat transfer coefficients were based on Table 1–2 of Heat Transfer, by J. P. Holman, using natural convection as the primary mechanism for both internal and external heat transfer. The overall heat transfer coefficient U is equal to 4.47 W/m$^2$K, which is very close to the value for the external heat transfer coefficient $h_o$.

The following example demonstrates that the external heat transfer coefficient $h_o$ also dominates the overall heat transfer coefficient equation in the case of forced convection. Gas cabinets are typically purged by drawing air into the bottom of the cabinet and providing exhaust, for example, in the top thereof. As a result, air continuously flows along the surface of the gas cylinder. Assuming a forced convection heat transfer coefficient of 12 W/m$^2$K (characteristic of airflow at 2 m/s over a square plate), the overall heat transfer coefficient for such a system is 11.8 W/m$^2$K. Thus, the primary resistance to heat transfer occurs between the ambient and the cylinder.

The external heat transfer coefficient $h_o$ is not constant along the entire surface of the cylinder. Because air enters the cabinet near the bottom of the cabinet, the direction of flow is across the cylinder (i.e., transverse to the longitudinal axis of the cylinder) in that region of the cabinet. In the region near the top of the cabinet, the air is traveling primarily in a vertical direction (i.e., parallel to the longitudinal axis of the cylinder).

Figure 3:
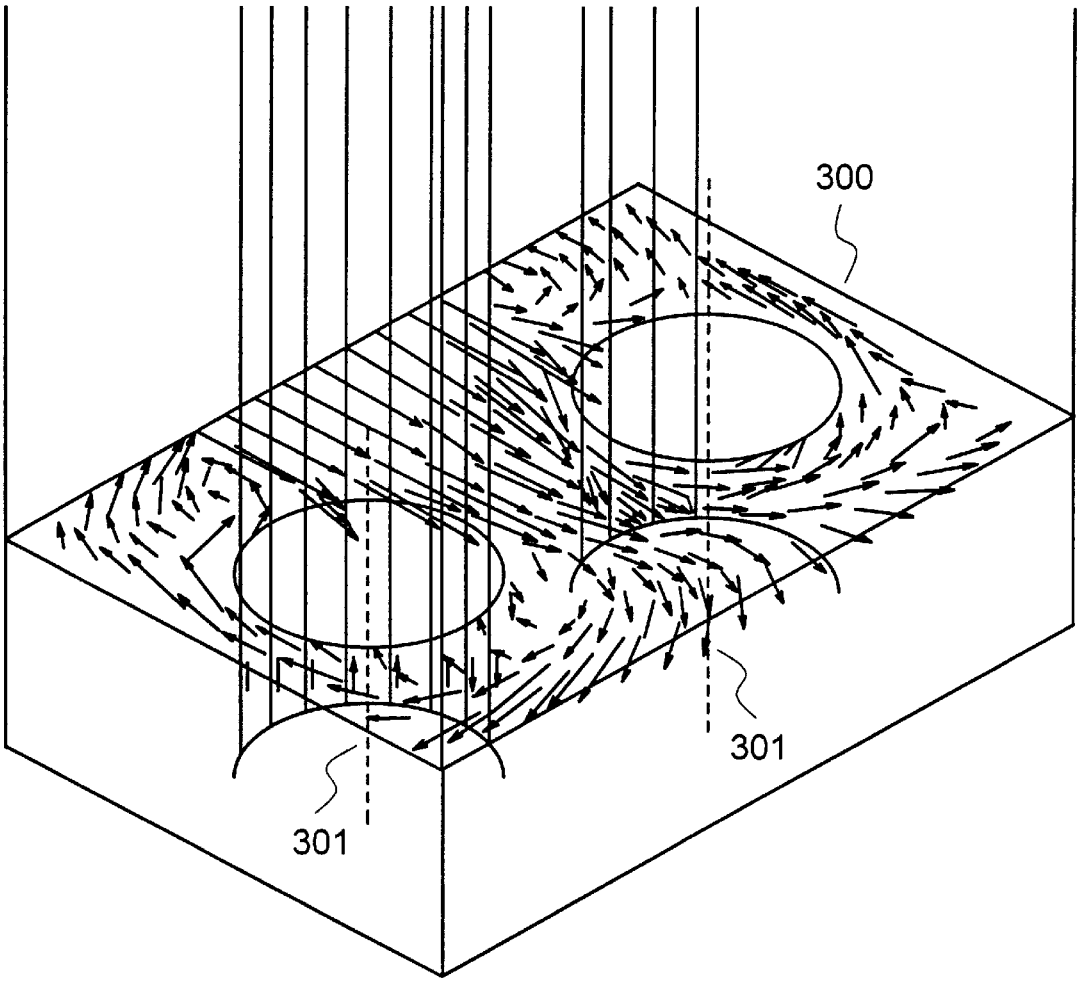
FIG. 3 is an illustration of air velocity vectors in a first plane in a gas cabinet.
Figure 4:
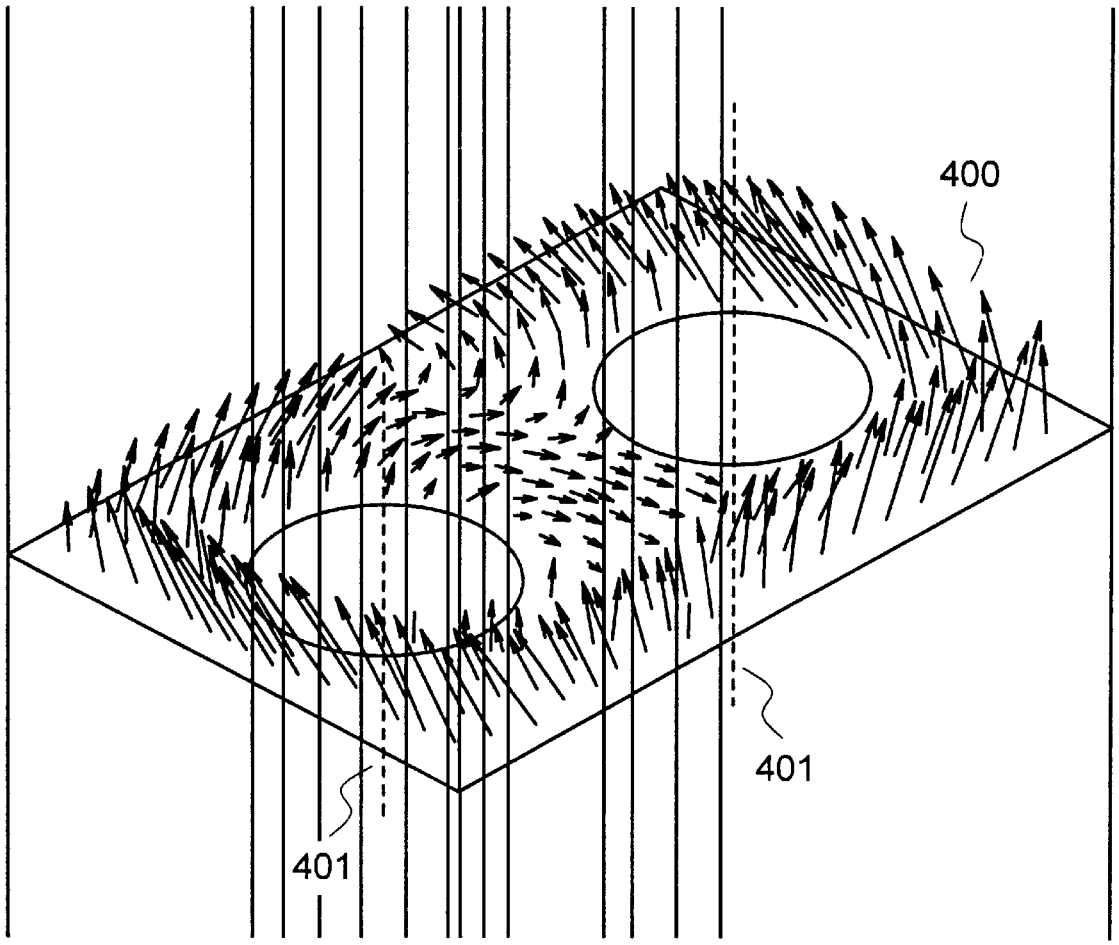
FIG. 4 is an illustration of air velocity vectors in a second plane vertically displaced from the first plane in the gas cabinet.

FIGS. 3 and 4 illustrate air velocity vectors within a gas cabinet at two different planes 300, 400 transverse to the longitudinal axes 301, 401 of the cylinders. Plane 300 in FIG. 3 is located where air is drawn into the gas cabinet at a position about 0.15 m from the bottom of the cabinet, while plane 400 is about 1 m from the bottom of the gas cabinet in FIG. 4. As shown in FIG. 3, the flow is primarily across the cylinders, transverse to the longitudinal axes 301 thereof near the bottom of the gas cabinet. Conversely, FIG. 4 shows that the air flow is primarily parallel to the cylinder longitudinal axis 401 near the top of the gas cabinet.

Figure 5:
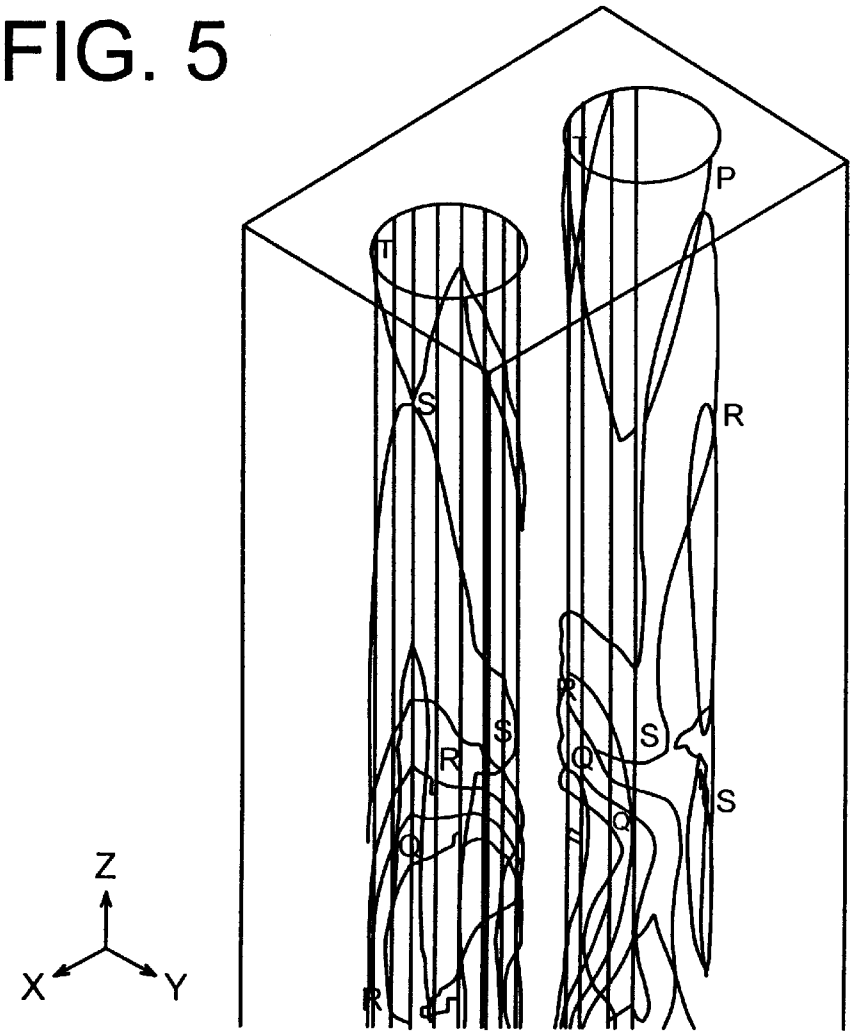
FIG. 5 is a contour map illustrating variations in external heat transfer coefficient along the outer surfaces of gas cylinders.

It was determined that the air flow pattern in the gas cabinet affects the local value of the external heat transfer coefficient $h_o$. A contour map of the external heat transfer coefficient $h_o$ along the length of the cylinders is provided in FIG. 5. The values of the external heat transfer coefficient $h_o$ are negative, indicating that energy flows from the ambient to the cylinders. However, absolute values are used in calculating the overall heat transfer coefficient U. Accordingly, comparisons made between heat transfer coefficients are based on the absolute values thereof. Thus, a heat transfer coefficient of −50 W/m$^2$K is considered larger than a coefficient of −25 W/m$^2$K. The value of the external heat transfer coefficient $h_o$ ranges from about −36 to about −2 W/m$^2$K., and the average value of the external heat transfer coefficient $h_o$ is −10.5 W/m$^2$K. Based on the results shown in FIG. 5, the external heat transfer coefficient was determined to be largest at a point opposite to the position at which ambient air is drawn into the cabinet. This results from the air direction and velocity magnitude in this region.

With an increase in the external heat transfer coefficient $h_o$ and the resultant increase in heat transfer rate, the external cylinder temperature also increases (assuming an identical process gas flowrate). Alternatively, a higher process gas flowrate can be utilized, thereby maintaining a similar difference in temperature between the ambient and the cylinder. It is, however, undesirable to withdraw material from the cylinder with too large of a temperature difference between the ambient and cylinder (and by analogy, between the cylinder and the liquid stored in the cylinder). The reason for this is the possible entrainment of liquid droplets in the gas withdrawn from the cylinder, resulting from different boiling phenomena. As the temperature difference between the cylinder and the liquid increases, the evaporation process changes from one of interface evaporation to a bubbling type of phenomena.

Figure 6:
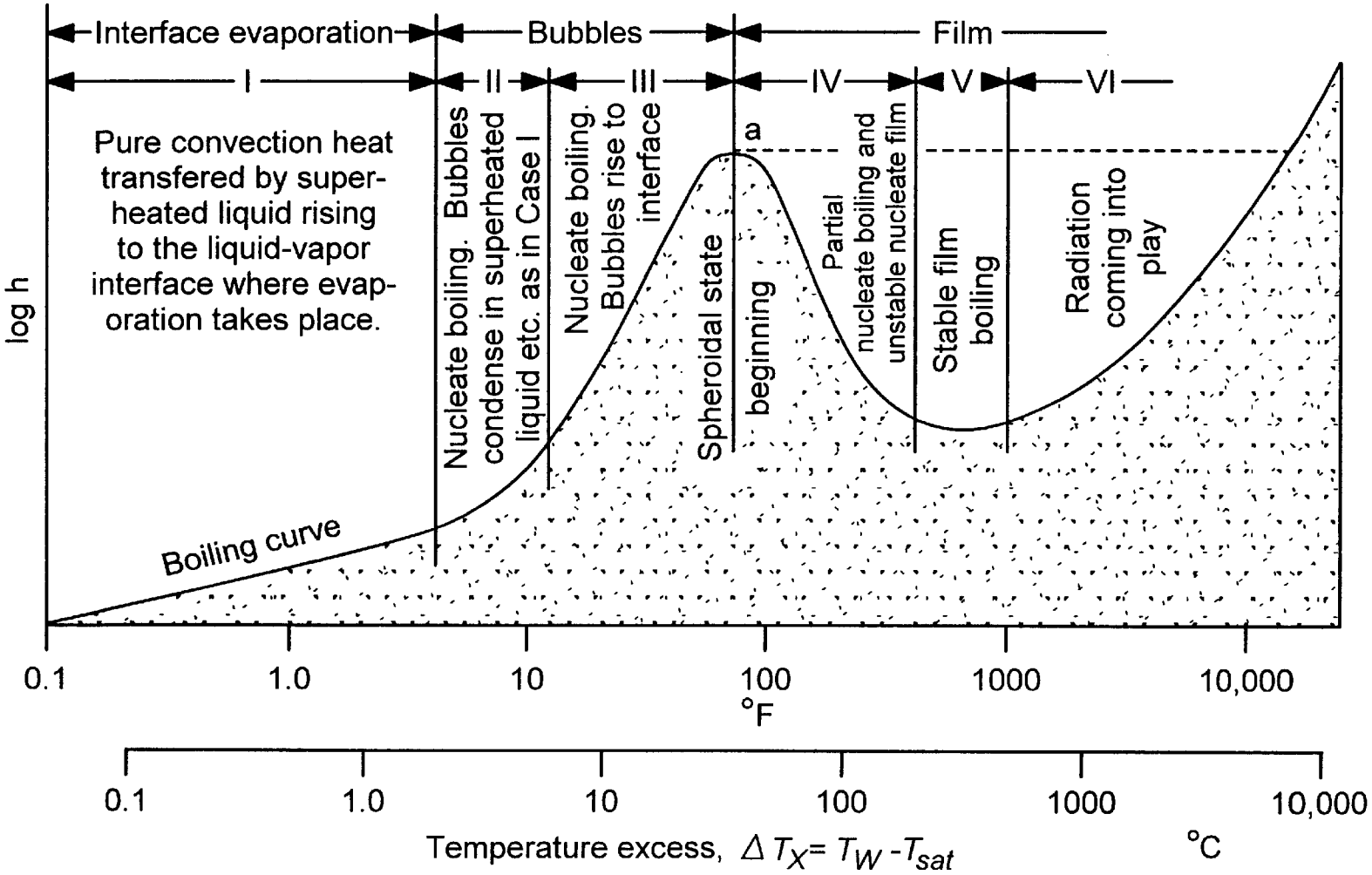
FIG. 6 illustrates the qualitative variation of the cylinder internal heat transfer coefficient as a function of the temperature difference between the cylinder and liquid in the cylinder.
Figure 7:
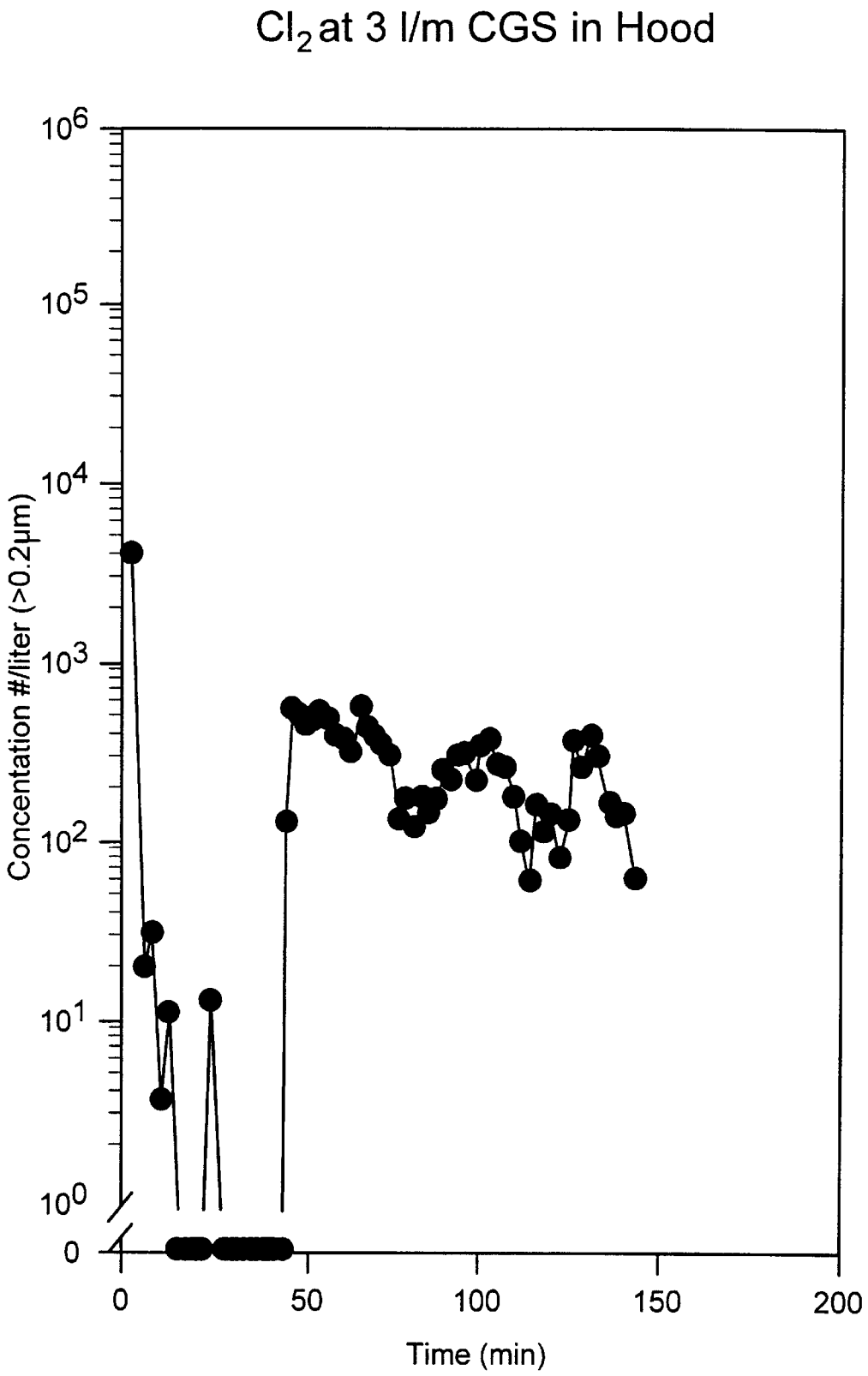
FIG. 7 is a graph that depicts the concentration of liquid droplets detected in a gas stream withdrawn from a $Cl_2$ cylinder at 3 slm as a function of time.

FIG. 6 illustrates the qualitative variation of the internal heat transfer coefficient $h_i$ with the temperature difference $\Delta T_x$ between the cylinder $T_w$ and the liquid stored in the cylinder $T_{sat}$. For small temperature differences, the evaporation process occurs at the liquid-vapor interface. At larger temperature differences, albeit only a few degrees larger, the vaporization process progresses through the formation of vapor bubbles in the liquid. As the bubbles rise to the interface, it becomes possible for small ultrafine droplets to become entrained in the gas flow. This entrainment of droplets has been observed, and is quantified for a $Cl_2$ cylinder with a 3 slm flowrate in FIG. 7, which shows the concentration of liquid droplets in a 3 slm $Cl_2$ gas flow as a function of time. After an initial decay in droplet concentration, which is related to the purging of droplets within the cylinder headspace, the droplet counts drop to zero for a period of time. As the temperature of the $Cl_2$ cylinder continues to decrease, the boiling phenomena eventually changes. This change is evidenced by a sharp increase in the number of droplet counts.

Figure 8:
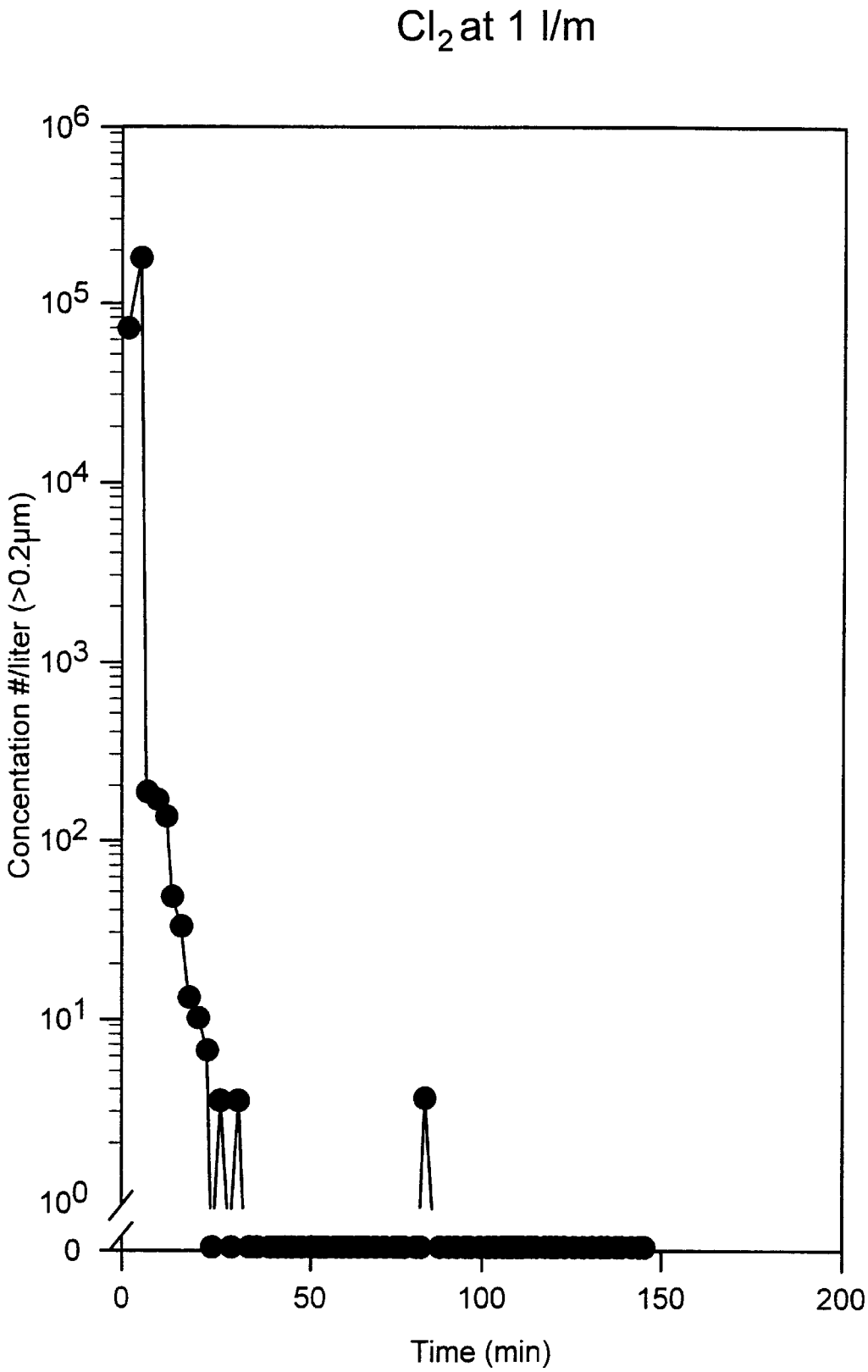
FIG. 8 is a graph that depicts the concentration of liquid droplets detected in a gas stream withdrawn from a $Cl_2$ cylinder at 1 slm as a function of time.

FIG. 8 illustrates the concentration of liquid droplets in a 1 slm $Cl_2$ gas flow as a function of time when using the exemplified block valve. A large number of droplets in the gas flow from the head space are initially present when opening the cylinder valve. These droplets exist in the head space in supersaturated conditions. As the flow of gas is continued, the droplets are eventually purged from the head space. The number of droplets in the gas flow is thereby reduced. It is believed that the droplets detected during the early stages are formed by a partial expansion process which occurs when the cylinder valve is opened, and/or that the droplets can be attributed to a number of equilibrium droplets suspended in the head space of the cylinder. Regardless of the formation mechanism, the length of time that these droplets are in the exiting gas is related to the liquid level in the cylinder (or in other words, to the head space volume) and the flowrate of the gas being removed from the cylinder. It has been determined that, if this gas containing entrained droplets is heated at constant pressure, the droplets can be evaporated.

Figure 9:
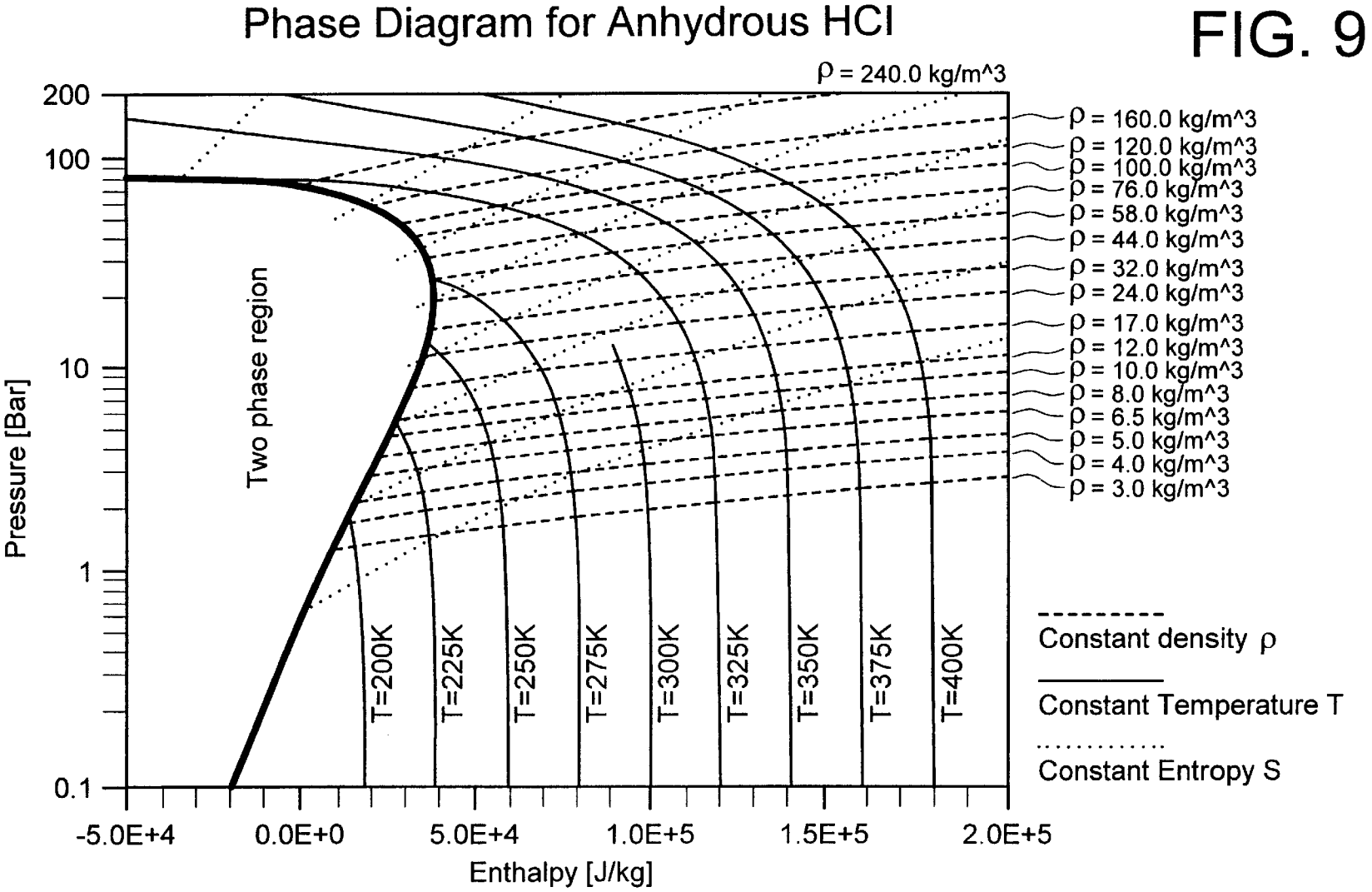
FIG. 9 is a phase diagram for anhydrous HCl.

The presence of liquid in the gas delivery system may be a result of the process of withdrawing the gas from the cylinder, local cooling due to ambient fluctuations, or droplet formation during the expansion process. Referring to FIG. 9, with an isenthalpic pressure reduction of HCl from a saturated vapor at 295 K, the material passes into the two phase region. The other gases listed in Tables 1 and 2 do not pass into the two phase region for an isenthalpic pressure reduction. However, the thermodynamic path that is followed during expansion is not isenthalpic (the actual expansion process is nearly isentropic because of the conversion of internal energy to kinetic energy) and has the possibility of entering the two phase region if inequality (II), below, is satisfied:

$$\left(\frac{\partial P}{\partial T}\right)_s < \frac{dP_{sat}}{dT} \quad \text{(II)}$$

wherein the left hand side of the inequality represents the change in pressure with the change in temperature at constant entropy, and the right hand side of the inequality represents the derivative of the vapor pressure as a function of temperature.

The above relation is satisfied for each of the gases listed in Tables 1 and 2. Since local control of the expansion process is difficult, it is necessary to heat the gas prior to expansion to prevent the expansion path from entering the two-phase region. If the gas is heated after withdrawal from the cylinder, the pressure does not rise and the difficulties of requiring strict thermal management are obviated.

The combination of the three mechanisms responsible for the presence of a liquid phase in the flowing gas in the system described above (i.e., droplets withdrawn from the cylinder, formation during expansion in the first component downstream of the cylinder, and the purging of droplets existing during flow startup) effectively limits the flowrate of gas that can be reliably supplied by an individual gas cabinet manifold. Currently, these limitations amount to several standard liters per minute, measured on a continuous basis. It has been determined that elimination of these liquid droplets in the process gases will allow a greater number of process tools to be connected to a single gas cabinet or, alternatively, the flowrate to a single processing tool can be increased substantially.

Figure 10:
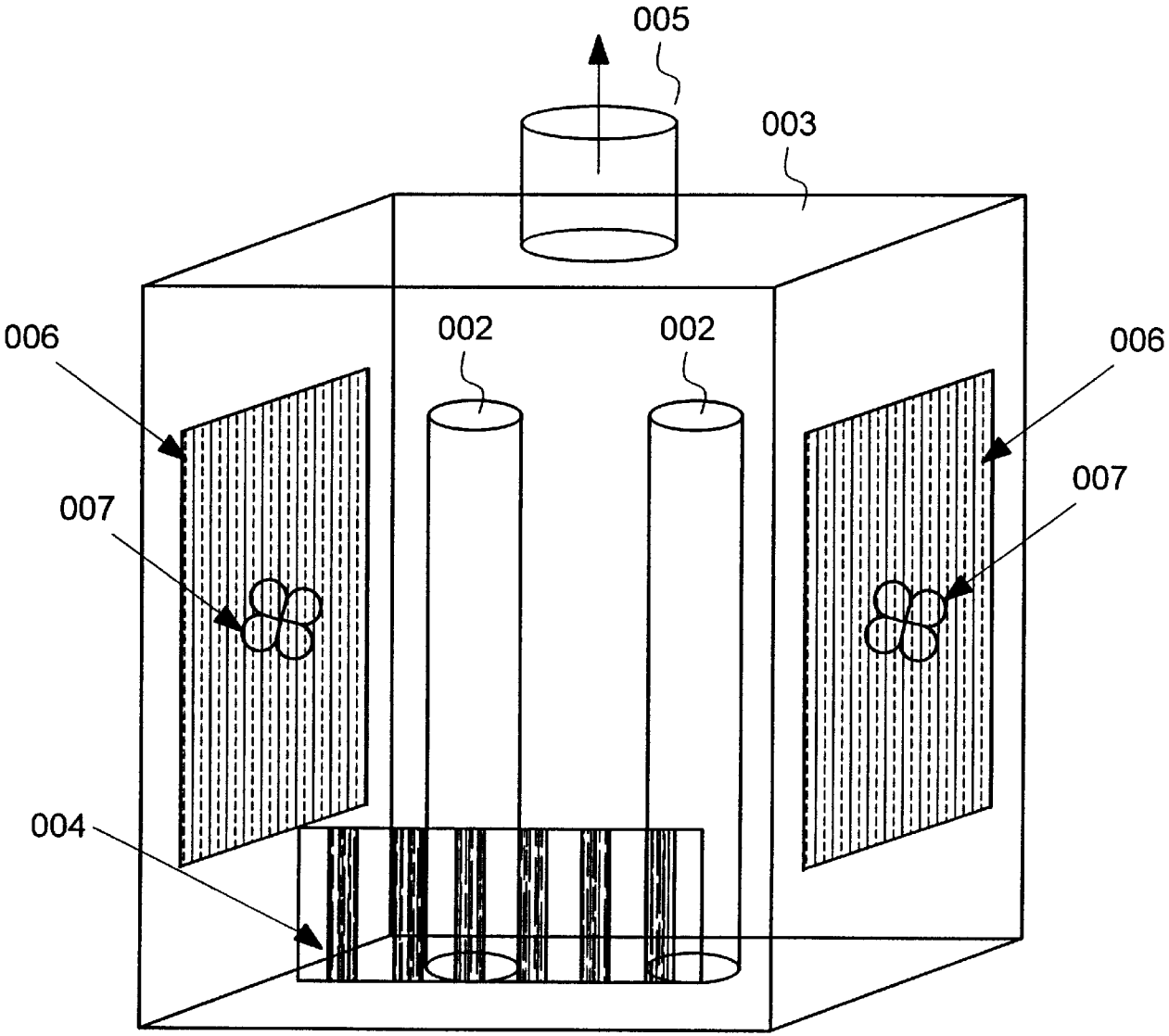
FIG. 10 is a diagram of a gas cabinet and a means for increasing the heat transfer rate between the ambient and gas cylinder according to one aspect of the invention.

With reference to FIG. 10, a preferred embodiment of the inventive system and method for delivery of a gas from a liquified state will be described. It is noted, however, that the specific configuration of the system will generally depend on factors such as cost, safety requirements and flow requirements of the cabinet.

The system comprises one or more compressed liquified gas cylinders 002 housed within a gas cabinet 003. The specific material contained within the liquified gas cylinder is not limited, but is process dependent. Typical materials include these specified in Tables 1 and 2, e.g., $NH_3$, $AsH_3$, $BCl_3$, $CO_2$, $Cl_2$, $SiH_2Cl_2$, $Si_2H_6$, HBr, HCl, HF, $N_2O$, $C_3F_8$, $SF_6$, $PH_3$ and $WF_6$. Gas cabinet 003 includes a grate 004 through which purging air enters the cabinet. This purging air is preferably dry, and is exhausted from the gas cabinet through exhaust duct 005.

The heat transfer rate between the ambient and gas cylinder is increased such that the liquid temperature in the gas cylinder is not increased to a value above the ambient temperature. Examples of suitable means for increasing the heat transfer rate include one or more plenum plates or an array of slits 006 in gas cabinet 003 through which air can be forced across the cylinder. An air blower or fan 007 can be used to force the air through the plenum plates or slits. Blower or fan 007 can preferably operate at variable speeds.

Suitable plenum plates having a maximum heat transfer coefficient for a given pressure drop (determined by the blower or fan characteristics) are commercially available from Holger Martin. Such components can easily be incorporated into a gas cabinet with minimal or no increase in gas cabinet size.

The plenum plates or slits can optionally be modified by adding fins which can direct air flow. It is preferable that the fins direct the air flow primarily towards the cylinder in the vicinity of the liquid-vapor interface.

The above-described scale cover/heater is particularly beneficial, since it can be fit into existing gas cabinets with negligible displacement of the gas cylinders, Therefore, it is unnecessary to retrofit or modify existing gas cabinets or gas piping.

The temperature of the plenum plates or slits can also be electrically controlled to a value slightly higher than ambient to further increase the rate of heat transfer. However, the temperature of the plenum plates or slits should be limited such that evaporation occurs only at the liquid-vapor interface, and to avoid heating the liquid inside the cylinder to a temperature above ambient.

Additionally or alternatively, radiant panel heaters or a heater disposed below the cylinder (e.g., a hot plate-type heater upon which the cylinder is set) can be used to increase the heat transfer rate between the ambient and gas cylinder. In a particularly preferred embodiment of the invention, the heat transfer rate is increased by use of a hot plate-type heater.

FIGS. 11A and B illustrate side-sectional and top views, respectively, of an exemplary hot-plate type heater. Heater 100 is in the form of a cover for a gravimetric scale, which scale can be enclosed by the heater. Such scales are known in the art and are conventionally disposed on the floor of gas cabinets. Cylinders containing liquified gases typically sit directly on the scale, with the scale providing a measure of the amount of material remaining in the cylinder. When using the heated scale cover exemplified in FIGS. 11A and B, the cylinder is disposed directly on the covered scale.

Heater 100 includes a top surface, i.e., top plate, 102 attached to a bottom surface, i.e., bottom plate 104, by means of a center spacer 106, a plurality of side spacers 108 and screws 110. The heater further includes a cavity 112 which contains a heating element (not shown). Suitable heating elements include, but are not limited to, resistance-type heaters such as electrical heating tape or preferably, self regulating-type heaters, such as heat trace. The heating element is preferably capable of being coiled within cavity 112. The heating element should be capable of operation at temperatures of from ambient to about 220° F.

To hold one end of the preferred heating element in place, the end can be fixed to a cutout 114 in center spacer 106. In this manner, the heating element can be coiled around the center spacer and optionally around the side spacers until the desired area is covered. It is desirable that the heating element cover the area of contact between the gas cylinder and the scale. A significant length of, for example, up to 16 feet or more of the heating element can be coiled within the heater. Given a 16 foot length of 20 watt/foot heating element, 320 watts of heat would be available from the heater.

The bottom of cavity 112 is preferably insulated using an insulation layer 116 to ensure that the heat from the heating element is directed upwards, towards the bottom of the gas cylinder. The insulation layer also serves to maintain contact between the heating element and top plate 102. The heater further includes front and rear panels 118, side panels 120 and bridge 122, which allow the heater to fit over the cylinder scale.

The materials of construction of heater 100 should allow effective heat transfer to the bottom of the gas cylinder. Top plate 102 is preferably made of a stainless steel, while the front, rear and side panels and the bridge are preferably constructed of aluminum or carbon steel.

Depending upon the specific type of heater employed, the temperature can be controlled in various ways. According to a preferred aspect of the invention, the power to the heater can be turned on or off based on the energy requirements of the gas cylinder. A preferred control method and algorithm for this purpose are described below.

According to a further aspect of the invention, heater 100 can include a concave, or cup-shaped, piece which can be attached to top plate 102 of the heater. The concave piece preferably conforms to the shape of the bottom of the gas cylinder such that more effective heat transfer to the cylinder is possible. The concave piece should be formed of a relatively hard material which is resistant to deformation upon contact with the gas cylinder and which is effective to transfer heat to the cylinder. Such materials include, for example, carbon steel and a stainless steel.

Figure 12:
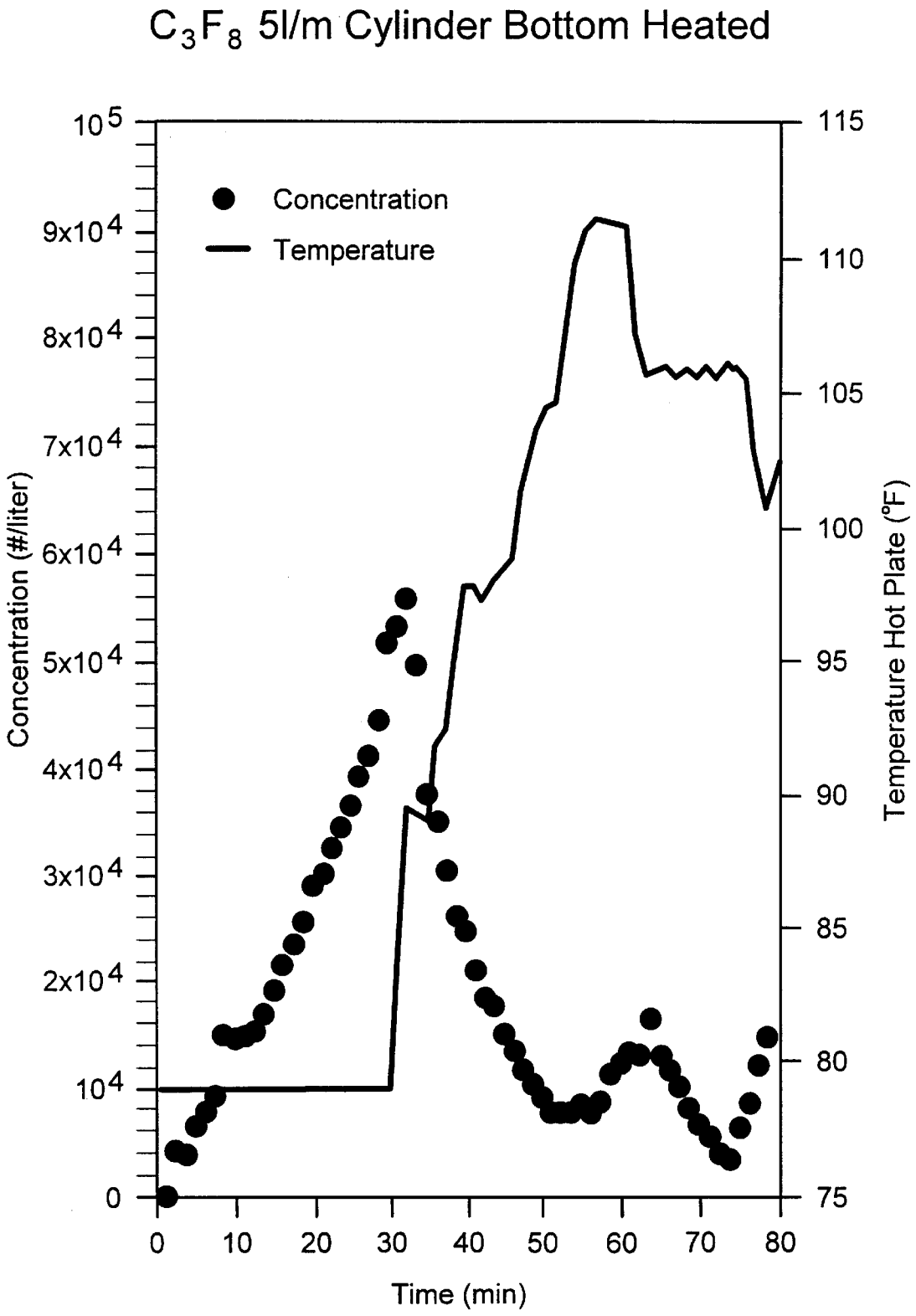
FIG. 12 is a graph that depicts the effects of heater temperature on the presence of liquid droplets as a function of time.

FIG. 12 is a graph illustrating the effect of heater temperature on the presence of liquid droplets in a gas flow as a function of time. The test was run with $C_3F_8$ at a flowrate of 5 slm, with the heater temperature being varied between about 78° F. and 112° F. The heater employed was a hot plate-type heater as described above. Significant reductions in liquid droplet concentration were obtained with an increase in the temperature of the heater.

Combinations of the above described means for increasing the heat transfer rate are also envisioned in the invention. For example, a radiant heater or a hot plate-type heater can be used in combination with a blower or fan as well as with the plenum plates or slits described above.

Operation of the system according to the invention will now be described with reference to FIG. 13. The gas is withdrawn from cylinder 302 through a gas line connected thereto. Preferred materials of construction for the gas line include electropolished stainless steel, hastelloy or monel, due to the corrosive nature of the gases.

The gas line further includes means 304 for reducing the pressure of the gas withdrawn from the cylinder. As described above, a pressure regulator or valve is suitable for this pressure reduction step. Such components are commercially available, for example, from AP Tech.

The system can further include means 306 for superheating the gas withdrawn from the gas cylinder, the superheating means being disposed upstream of the pressure reducing means. Superheating the gas can prevent the deleterious effects stemming from the transfer of liquid droplets or mist in the cylinder head space, which are characteristic during initial gas flow from the cylinder. The superheating means ensures that the fluid is entirely in the vapor form by vaporizing any entrained liquid droplets. Furthermore, the superheating means ensures a minimum degree of superheating of this vapor to avoid the possibility of droplet formation in a subsequent expansion process.

The superheating means can be any unit which effectively removes the entrained liquid droplets from the gas stream, such as a heated line. The line can be heated by, for example, a resistance-type heater provided along a length of the gas line, such as electrical heating tape, or a self regulating-type heater such as heat trace can be used.

Figure 14B:
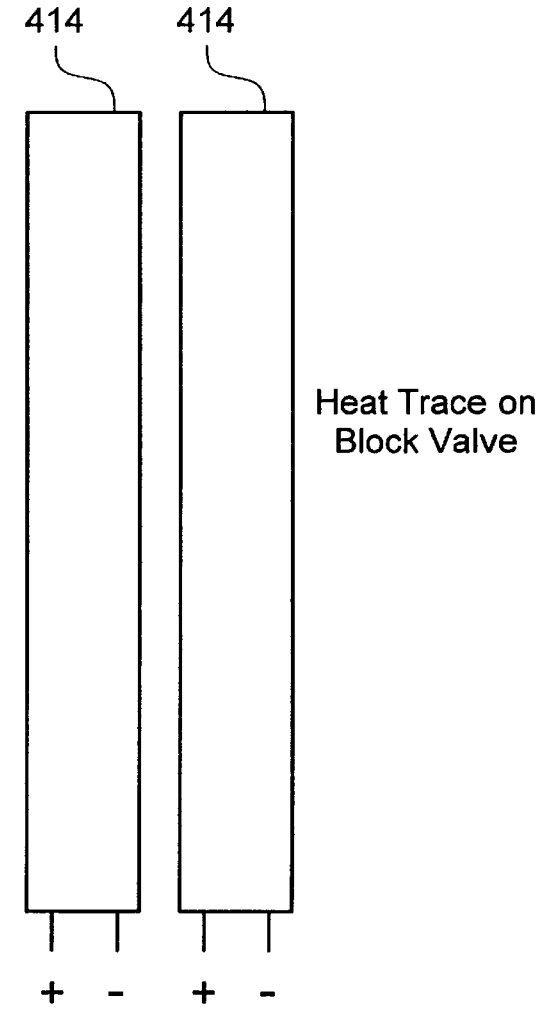
FIGS. 14A and B illustrate a means for superheating a gas flow in accordance with one aspect of the invention.
Figure 14A:
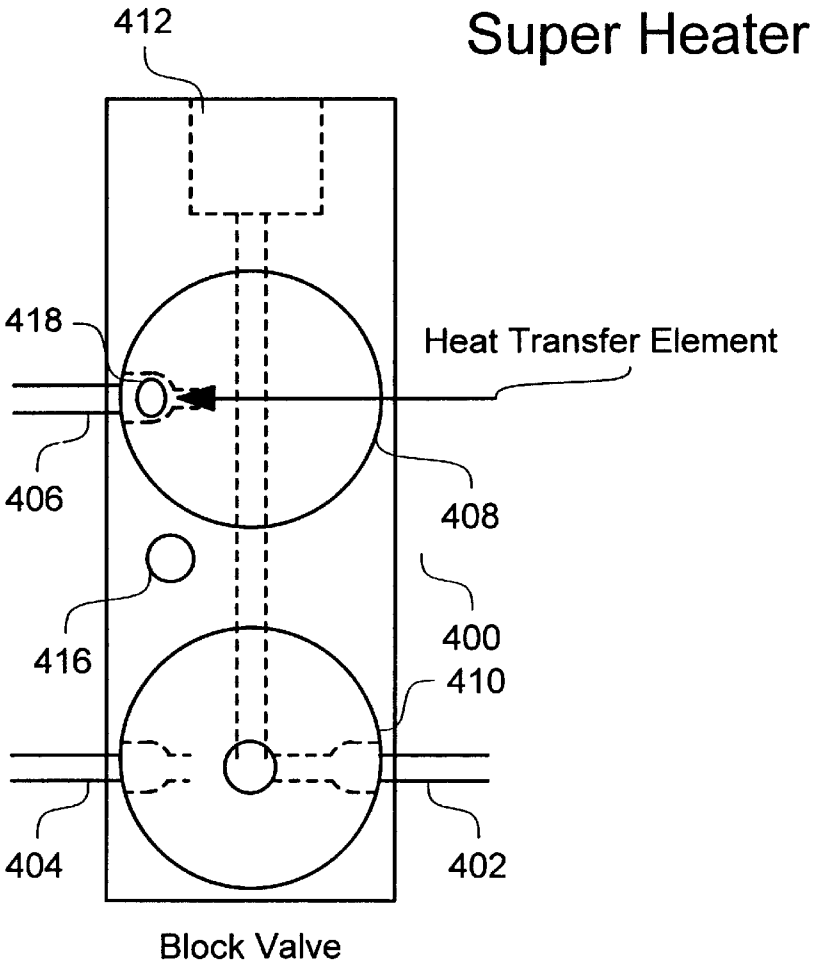

According to a preferred embodiment of the invention, the superheating means can take the form of a modified block valve. With reference to FIGS. 14A and 14B, the block valve 400 is connected to the gas cylinder through suitable gas piping and fittings (not shown in figure). The piping is connected to the block valve at inlet port 402. The block valve further includes purge gas inlet port 404, through which an inert gas, such as nitrogen or argon, can be introduced into the valve. The process gas introduced through inlet port 402 exits the valve through outlet port 406, which is connected to the point of use, for example, a processing tool, through suitable gas piping, fittings, valves, etc. The block valve is operated by actuators 408 and 410, which can open or close the gas flow paths within the valve. The pressure of the gas within the valve is monitored by a pressure measurement device, such as pressure transducer 412.

Heat can be supplied to block valve 400 by one or more heating elements 414 attached to or inserted into the block valve. The heating elements should have the capability of providing a constant heat flux to the block valve. Suitable heating elements include, but are not limited to, a self regulating-type heater such as heat trace, a resistance-type heaters such as electrical heating tape or a cartridge heater. As shown in the illustrated embodiment, one or more strips of heat trace 414 can be attached to the backside of the block valve for this purpose. In the case of a self-regulating heater such as heat trace, the heater can be kept on at all times. Conversely, if a cartridge heater is used, it can be inserted into the block valve, for example at position 416.

To improve heat transfer efficiency, the block valve preferably includes a sintered metal disc 418 added to outlet port 406. Metal disc 418 can take the form of a filter having a pore size of, for example, from about 1 to 60 $\mu$m, preferably from about 5 to 30 $\mu$m. Since metal disc 418 is heated by the heating element, it provides additional heated surface area for the gas to contact. Metal disc 418 thereby helps to provide the requisite energy to ensure that any liquid in the gas stream is vaporized.

The metal disk can be welded in place in the outlet port. The material of construction of the metal disk is selected on the basis of the process gas flowing through the valve. That is, the material of construction should be compatible with the process gas to prevent contamination of the process gas as well as to prevent damage to the various gas line components. Typical materials for the metal disc include but are not limited to stainless steel (e.g., 316L), hastelloy and nickel.

In addition to the above-described structures, the superheating means can be a unit for heating air or inert gas, preferably dry, which is blown onto a section of the gas line by a blower or fan. The heated air or inert gas can also be used to heat the gas stream by use of a coaxial line structure.

Additionally or alternatively, the superheating means can include a heated gas filter and/or a heated gas purifier provided in the line. The sintered metal disc described above is one such type of filter. The heated gas filter can remove particulates in the gas and provides a large surface area for heat transfer. The heated gas purifier can remove unwanted contaminants from the gas in the cylinder and provides a large surface area for heat transfer.

Figure 15:
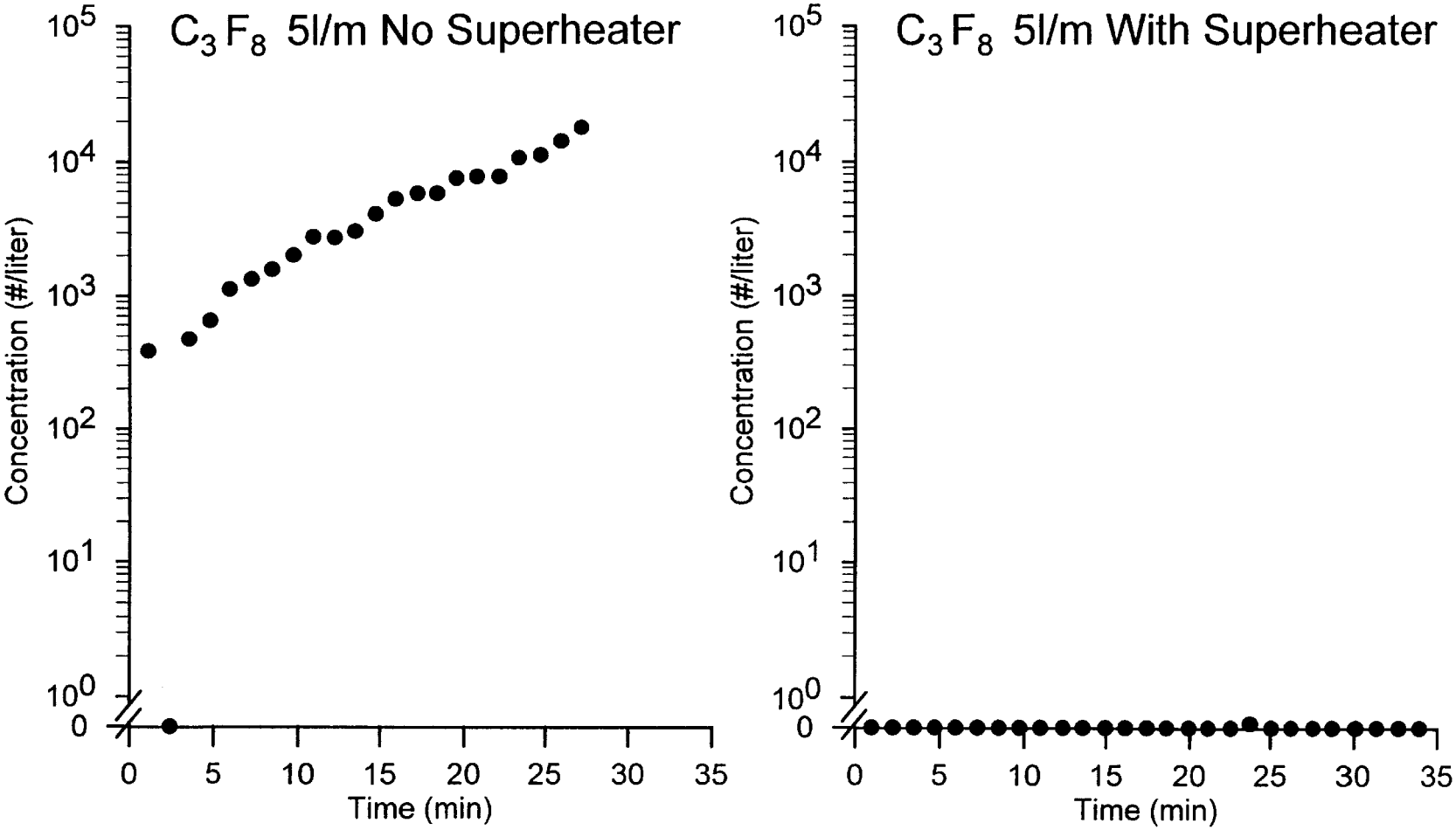
FIG. 15 shows two graphs that illustrate the effectiveness of a superheater in eliminating the presence of liquid droplets in a gas flow.

FIGS. 15A and 15B demonstrate the effectiveness of a superheater in reducing the number of liquid droplets observed when initially opening a gas cylinder valve. Tests at 5 slm $C_3F_8$ with no superheater (FIG. 15A) and with a superheater (FIG. 15B) were run. The superheater employed was a heated block valve as described above. The number of liquid droplets observed in the gas flow with no superheater ranged from about 3800 per l to about 19,000 per l. Those droplets were effectively eliminated when using the superheater.

Figure 13:
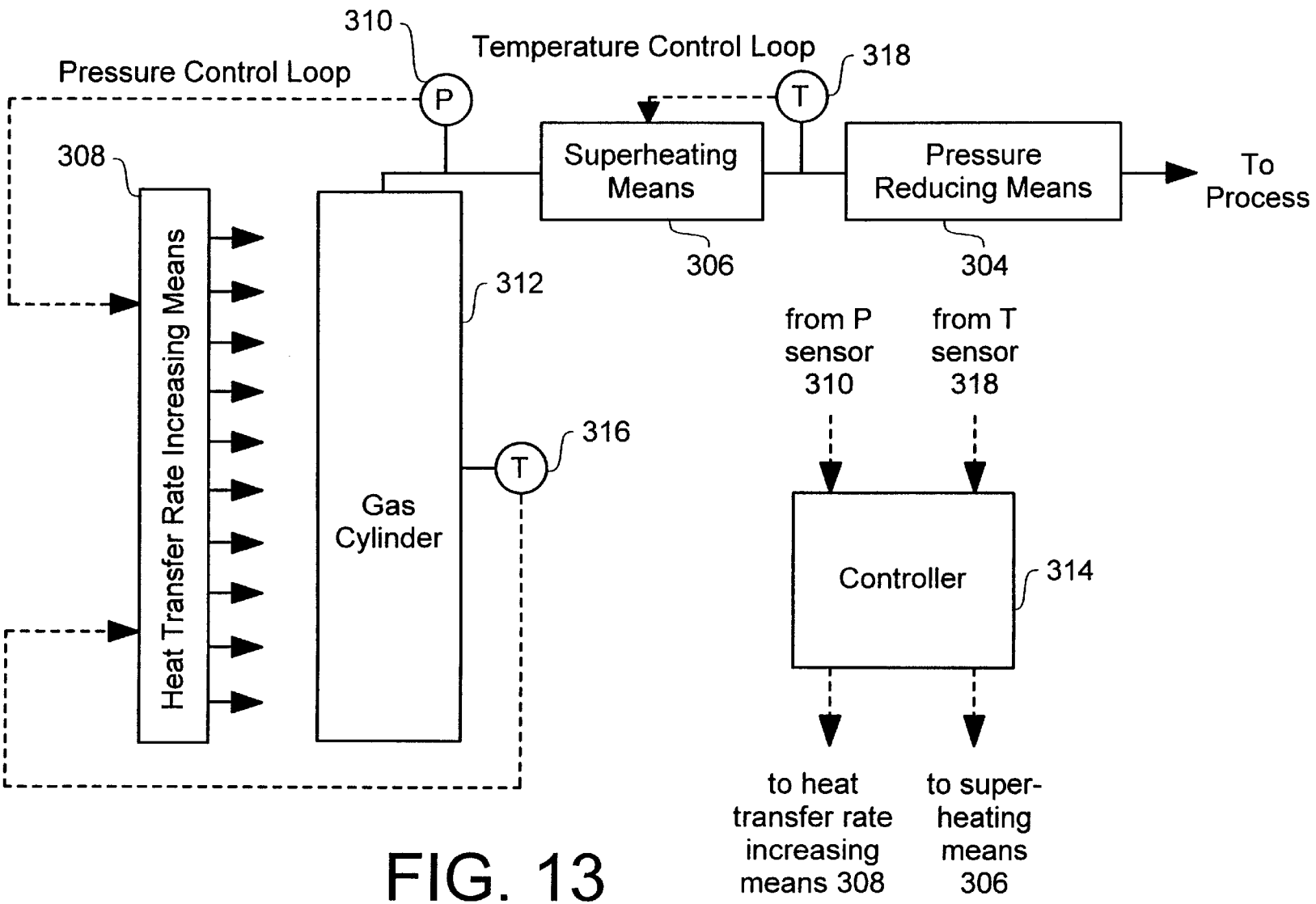
FIG. 13 is a schematic diagram of the system for controlling the delivery of liquified gases according to one aspect of the invention.

Referring back to the schematic diagram of FIG. 13, the system can further include means for integratably controlling the heat transfer rate increasing means 308 and the superheating means 306. This control means allows for precise control of cylinder pressure and temperature, as well as the degree of superheating the gas withdrawn from the cylinder upstream of the pressure reducing means 304. Thus, a constant cylinder pressure, a cylinder temperature at or slightly below ambient temperature, and a desired degree of gas superheating prior to expansion can all be attained.

Suitable control means are known in the art, and include, for example, one or more programmable logic controllers (PLCs) or microprocessors. Pressure sensor 310 monitors the pressure at the exit of cylinder 312. The pressure read by the pressure sensor indicates the pressure at which vaporization is occurring, and further provides input to a controller 314 which adjusts the heat transfer rate increasing means. This adjustment can be based, for example, on the instantaneous pressure value and its history. An optional cylinder overheating sensor 316 can also be provided to override the controller in the event a predetermined temperature limit is exceeded.

The superheating means 306 and the gas temperature immediately upstream of the pressure reduction device 304 are controlled in a similar manner to that described above.

The control system for the superheating means includes temperature sensor 318, which is located downstream from superheating means 306 and upstream from the pressure reduction means 310. Based on the output of the temperature sensor, controller 314 sends a control signal to superheater 306, thereby adjusting the gas temperature.

The setpoint for the superheating control temperature will depend, for example, on the current cylinder pressure and cylinder wall temperature. As the implied difference between the cylinder wall temperature and the liquid temperature (as defined by the vapor pressure curve) increases, the amount of energy required by the superheater increases since a greater number of liquid droplets are being withdrawn.

The degree of superheating can be controlled as a function of energy output or temperature. Where it is desired to control the degree of superheating as a function of energy output, the following equation governs the superheater output:

$$q=A(T_{liq}(P_{cylinder})-T_{wall})+B \quad \text{(II)}$$

wherein A and B are constants which depend on the vapor pressure curves for the specific gases involved and $T_{liq}$ is derived from the cylinder pressure measurement by the vapor pressure curve. A similar equation is applicable in the case in which the degree of super-heating is controlled as a function of temperature. For certain gases, it may be possible that the superheater setpoint will not change with cylinder pressure. This is most likely true for low pressure gases.

Figure 16:
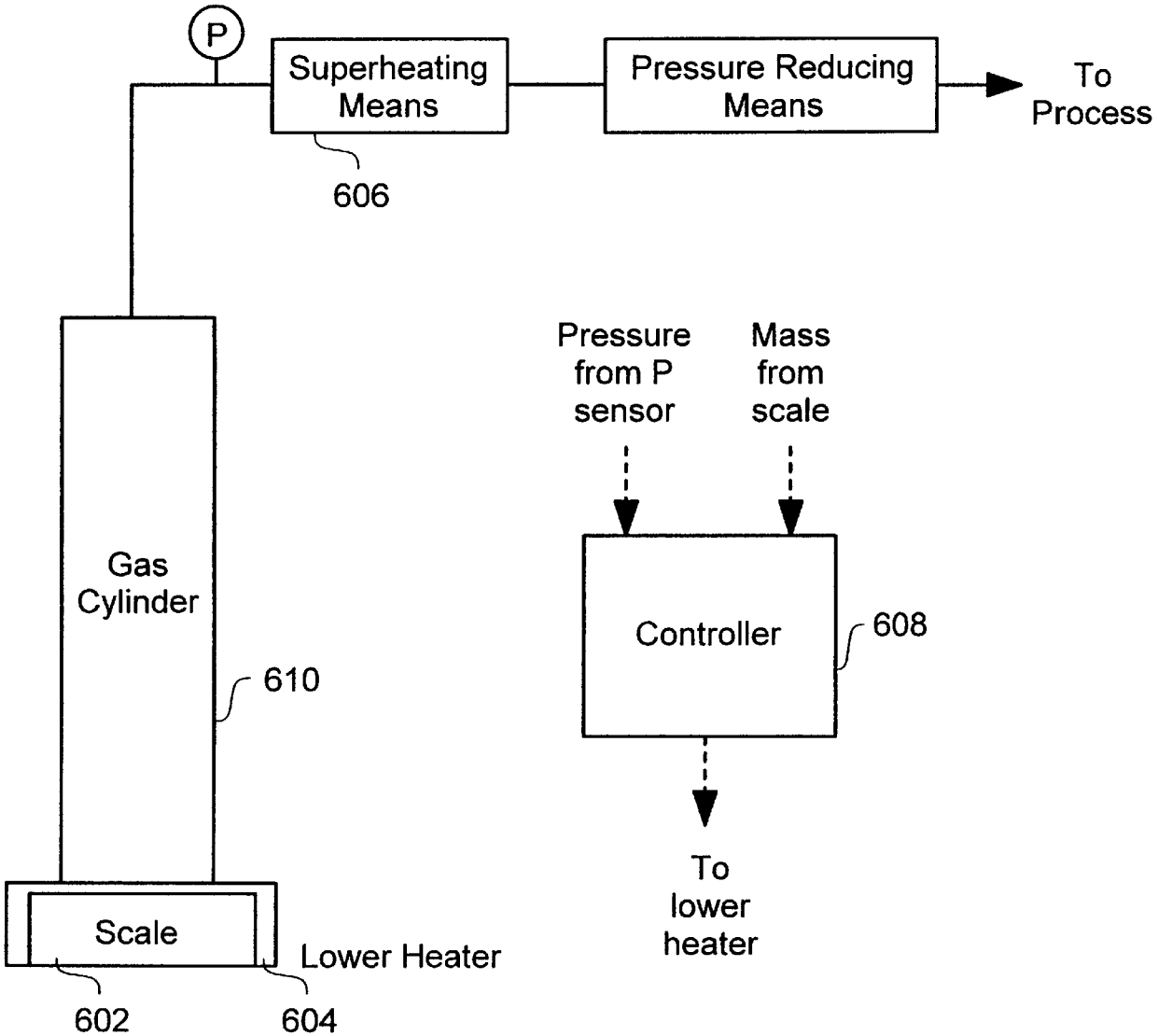
FIG. 16 is a schematic diagram of a preferred system for controlling the delivery of liquified gases according to one aspect of the invention.

With reference to FIG. 16, the following is a description of a further control system for delivering liquified gases in accordance with the present invention. Without being limited to any specific heating components, the exemplary control system is used in conjunction with a gas delivery system which includes a scale 602 and a bottom heater/scale cover 604 as well as a block valve superheater 606 as described above.

Preferably, the block valve is heated with a self-regulating heating element, such as heat trace. As a result, power can continuously be applied to the block valve heater without further control. The control system determines the energy requirements of the gas cylinder, and switches the power to the bottom heater on or off depending on those requirements. The exemplary control system is based on one or more programmable logic controllers (PLCs) 608, although other known forms of computer control are also envisioned.

Figure 18:
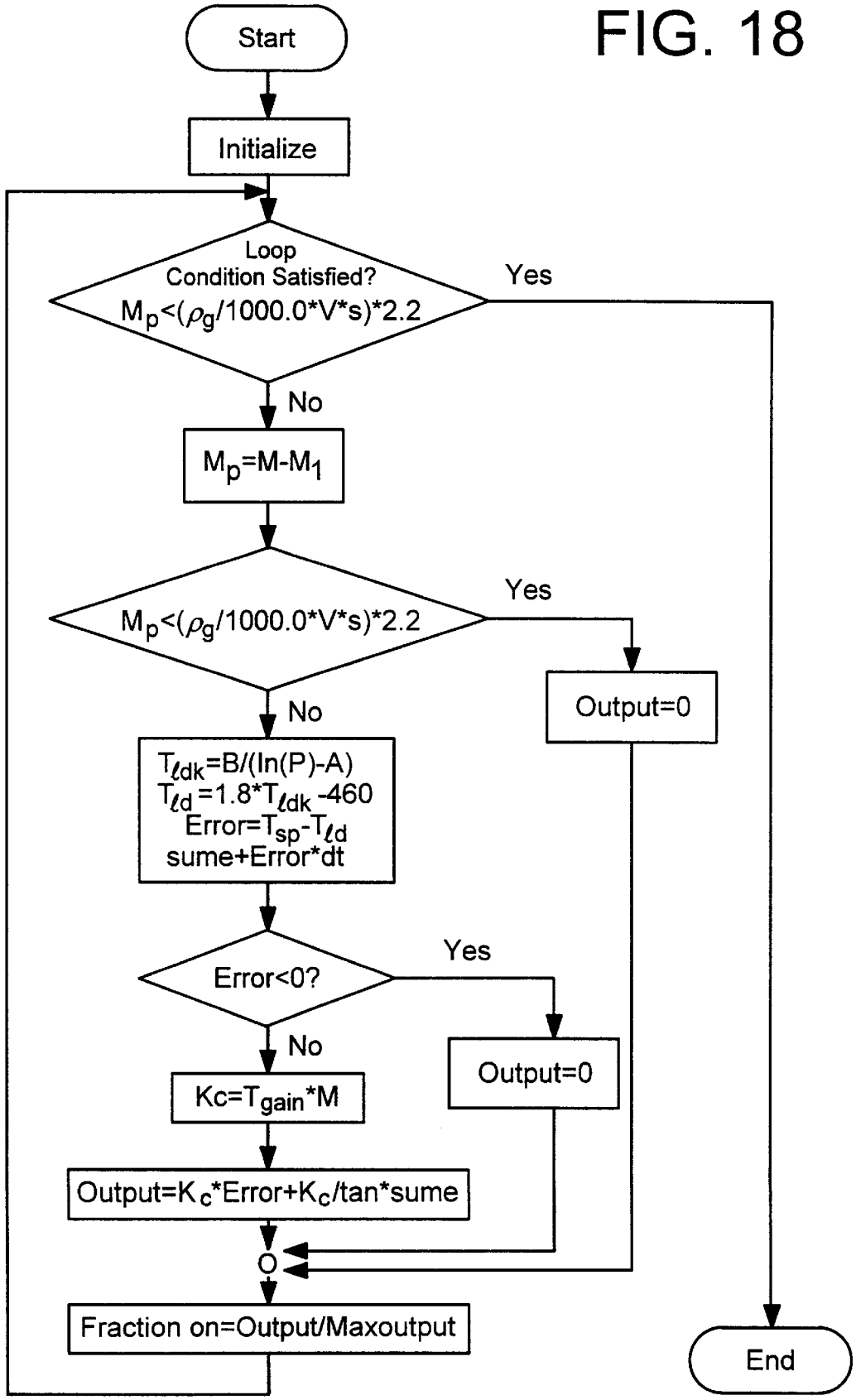
FIG. 18 is a flowchart of the control algorithm of FIG. 17.

To ensure that vapor phase only flows from the gas cylinder 610, an algorithm was written for use with the PLC to determine the energy requirements of the cylinder. The steps of the algorithm are shown in FIG. 17, and in flow chart form in FIG. 18.

The algorithm requires as input variables, among others, gas cylinder pressure P and gas cylinder mass (i.e., tare weight) $M_t$. The cylinder pressure is measured by a pressure measuring device, such as a pressure transducer in the heated block valve. The cylinder mass is measured by the scale covered by the lower heater upon which the cylinder is set in the gas cylinder cabinet. The cylinder pressure and mass are read by the PLC, and the energy requirements of the cylinder are thereby directly correlated with the cylinder's usage.

In particular, the weight of the product remaining in the cylinder $M_p$ is calculated by subtracting the tare weight (i.e., the empty cylinder weight, which is an input variable) from the cylinder weight M, as measured by the scale. All weights are measured in pounds.

$M_p$ is next compared with the inequality, $(\rho_g/1000.0*V*s)*2.2$, in which $\rho_g$ is the density of the gas vapor at room temperature and cylinder pressure, measured in $kg/m^3$. $\rho_g$ is provided by a table which is input into the PLC. V (an input variable) is the volume of the cylinder in liters, and s is a safety factor. The safety factor is used to prevent complete depletion of the liquid in the gas cylinder since impurities tend to be concentrated in the residual liquid at the bottom of the cylinder. Such impurities are potentially harmful to the components of the gas delivery system as well as to the semiconductor devices being formed. While not being limited in any way, typical values for the safety factor s are from 1.1 to 1.3

In the event $M_p$ is less than the inequality value described above, the "Output" function is assigned a value of zero. In such a case, the heater is not turned on since the "Fraction On" function (Fraction On=Output/Maxoutput) is also equal to zero.

Conversely, if $M_p$ is greater than the inequality value described above, then the liquid temperature in degrees K $T_{ldK}$ is calculated from the equation, $T_{ldK}=(B/(\ln(P)-A)$, wherein A and B are constants determined from the vapor pressure curve of the particular material. A is the y-intercept of the vapor pressure curve, while B is the slope of the vapor pressure curve. A table of values for A and B is preprogrammed into the PLC. The pressure P in psia is measured by the pressure sensor.

Next, the liquid temperature $T_{ldK}$ is converted to temperature $T_{ld}$ in °F. by the equation, $T_{ld}=1.8*T_{ldK}$. The temperature $T_{ld}$ is compared with a temperature set point $T_{sp}$ in °F. (an input value), and the temperature difference ("Error") is calculated by the equation, $Error=T_{sp}-T_{ld}$.

The "sume" function is next calculated by the equation sume=sume+Error*dt, wherein dt is the sample time (the sume function was originally set to a value of zero after initialization of the control algorithm). "Sume" represents the sum of the errors, i.e., the temperature difference.

The value of the "Error" function is next checked. If that value is less than zero, then the "Output" function is assigned a value of zero. If, however, that value is not less than zero, a value for $K_c$ is calculated by the equation, $K_c=T_{gain}*M$, wherein $T_{gain}$ represents the heat capacity of the gas cylinder and liquid contained therein per second, in units of W/°F.-lb. While not limited in any way, $T_{gain}$ can have a value, for example, of from 10 to 100 W/°F.-lb. In the exemplary system, $T_{gain}$ is equal to about 30 W/°F.-lb. $K_c$ represents the power required to raise the temperature of the system (cylinder and liquid) 1° F., and has units of W/°F.

The "Output" function is next calculated by the equation, $Output=K_c*Error+K_c/tau*$ sume. Tau is a constant which is based on the delay time in the response of the heater to the control system.

The "Fraction On" function is then determined by the equation, Fraction On=Output/Maxoutput. The "Fraction On" function represents the period of time for which the heater is to be turned on. "Maxoutput" represents the maximum power of the heater, in watts. Through the control system, the power to the heater is turned on for the period of time calculated for the "Fraction On" function.

The control loop is continued until the inequality $M_p<\rho_g/1000.0*V*s)*2.2$ is met, at which time the gas cylinder should be replaced and the algorithm reinitialized.

In addition to maximizing the capability of the delivery of only vapor phase from the gas cylinder, the algorithm and control system described above can maximize gas flow rates as well as the length of time a cylinder can deliver such high flows.

A particularly beneficial aspect of the control system described above makes it possible to scale the system up to assure all vapor phase delivery of gases from significantly larger liquified gas sources than cylinders, such as bulk storage vessels and trailers.

As a consequence of the invention, a substantial increase in process gas flowrate from liquified gases in cylinders can be achieved with minimal or a complete absence of entrained liquid droplets in the gas stream. Liquid droplets removed from the cylinder are effectively eliminated, and the possibility of droplets being formed during the expansion process is also minimized or eliminated.

Because the temperature of the liquid inside the cylinder vis-a-vis the cylinder temperature is maintained at a value equal to or slightly less than ambient temperature, strict thermal management downstream of the heater is rendered unnecessary. Also, due to the lack of any thermal driving force associated with the inventive system and method, condensation in the piping system downstream of the cylinder cabinet can be avoided.

It has been estimated that an increase in external heat transfer coefficient $h_o$ attainable by the inventive system and method is about 100 $W/m^2K$. This translates into a substantial increase in heat transfer rate between the ambient and the gas cylinder without increasing the liquid temperature above ambient temperature. As a result, gas flowrate can be increased by approximately a factor of 10.

While the invention has been described in detail with reference to specific embodiments thereof, it will be apparent to those skilled in the art that various changes and modifications can be made, and equivalents employed, without departing from the scope of the appended claims.

What is claimed is:

1. A system for delivery of a gas, suitable for use as a semiconductor process gas, from a liquified state, the system comprising:

(a) a compressed liquified gas cylinder having a gas line connected thereto through which the gas is withdrawn;

(b) a gas cylinder cabinet in which the gas cylinder is housed; and (c) means for increasing the heat transfer rate between ambient and the gas cylinder without increasing the temperature of the liquid inside the gas cylinder above ambient temperature.

2. The system for delivery of a gas according to claim 1, further comprising:

(d) means for reducing the pressure of the gas withdrawn from the gas cylinder; and (e) means for superheating the gas withdrawn from the gas cylinder, wherein the superheating means is disposed upstream of the pressure reducing means.

3. The system for delivery of a gas according to claim 2, wherein the superheating means comprises a heated gas filter or a heated purifier.

4. The system for delivery of a gas according to claim 2, wherein the superheating means comprises a heater in contact with the line.

5. The system for delivery of a gas according to claim 4, wherein the heater in contact with the line comprises electrical heating tape.

6. The system for delivery of a gas according to claim 2, wherein the superheating means comprises means for heating air and means for blowing the heated air onto a section of tube through which the gas flows.

7. The system for delivery of a gas according to claim 2, wherein the superheating means comprises a heated valve comprising a gas inlet port, a gas outlet port an actuator for opening and closing the valve and a heater in thermal contact with the valve.

8. The system for delivery of a gas according to claim 7, wherein the heated valve is a block valve.

9. The system for delivery of a gas according to claim 7, the heated valve further comprising a second gas inlet port, through which a purge gas can enter the valve.

10. The system for delivery of a gas according to claim 7, the heated valve further comprising a pressure measurement device connected thereto.

11. The system for delivery of a gas according to claim 7, wherein the heater is selected from the group consisting of self regulating-type heaters, resistance-type heaters and cartridge heaters.

12. The system for delivery of a gas according to claim 11, wherein the heater is heat trace.

13. The system for delivery of a gas according to claim 2, further comprising:

(f) means for integratably controlling the heat transfer rate increasing means and the superheating means, such that pressure and temperature of the gas cylinder and the degree of superheating the gas withdrawn from the gas cylinder upstream from the pressure reducing means can be controlled.

14. The system for delivery of a gas according to claim 1, wherein the heat transfer rate increasing means comprises one or more openings in the gas cabinet and a means for forcing a heat transfer gas through the one or more openings.

15. The system for delivery of a gas according to claim 14, wherein the heat transfer gas is air or an inert gas.

16. The system for delivery of a gas according to claim 14, wherein the one or more openings in the gas cabinet comprise one or more plenum plates or slits.

17. The system for delivery of a gas according to claim 16, wherein the one or more plenum plates or slits comprise fins for directing the flow of the heat transfer gas.

18. The system for delivery of a gas according to claim 16, wherein the heat transfer rate increasing means further comprises means for electrically controlling the temperature of the one or more plenum plates or slits to a value slightly higher than ambient temperature.

19. The system for delivery of a gas according to claim 1, wherein the heat transfer rate increasing means is capable of directing an air flow substantially to a position on the cylinder corresponding to a liquid-vapor interface.

20. The system for delivery of a gas according to claim 1, wherein the heat transfer rate increasing means comprises one or more radiant panel heaters.

21. The system for delivery of a gas according to claim 1, wherein the heat transfer rate increasing means comprises a heater disposed below the cylinder.

22. The system for delivery of a gas according to claim 21, wherein the heater disposed below the cylinder is a heated scale cover, the scale cover comprising an upper surface, a lower surface and a heating element disposed within a cavity formed between said upper and lower surfaces, the system further comprising a scale for measuring the weight of the cylinder.

23. The system for delivery of a gas according to claim 22, the scale cover further comprising a concave-shaped piece attached to the upper surface.

24. The system for delivery of a gas according to claim 22, further comprising means for controlling the heat output from the heated scale cover based on cylinder pressure and weight inputs.

25. A semiconductor processing system, comprising a semiconductor processing apparatus and the system for delivery of a gas according to claim 1.

26. A method for delivery of a gas, suitable for use as a semiconductor process gas, from a liquified state, the method comprising:

(a) providing a compressed liquified gas in a gas cylinder having a gas line connected thereto, the gas cylinder being housed in a gas cylinder cabinet; and (b) increasing the heat transfer rate between an ambient and the gas cylinder without increasing the temperature of the liquid in the gas cylinder above the ambient temperature.

27. The method for delivery of a gas according to claim 26, further comprising:

(c) superheating the gas withdrawn from the gas cylinder prior to expansion of the gas.

28. The method for delivery of a gas according to claim 27, wherein the step of superheating the gas withdrawn from the gas cylinder comprises superheating the gas with a heated gas filter or a heated purifier.

29. The method for delivery of a gas according to claim 27, wherein the step of superheating the gas withdrawn from the gas cylinder comprises superheating the gas with a heater in contact with the line.

30. The method for delivery of a gas according to claim 29, wherein the heater in contact with the line comprises electrical heating tape.

31. The method for delivery of a gas according to claim 27, wherein the step of superheating the gas withdrawn from the gas cylinder comprises heating air and blowing the heated air onto a section of tube through which the gas flows.

32. The method for delivery of a gas according to claim 27, wherein the step of superheating the gas withdrawn from the gas cylinder comprises heating the flow of gas in a valve comprising a heater in thermal contact with the valve.

33. The method for delivery of a gas according to claim 32, wherein the heated valve is a block valve.

34. The method for delivery of a gas according to claim 32, wherein the heater is selected from the group consisting of self regulating-type heaters, resistance-type heaters and cartridge heaters.

35. The method for delivery of a gas according to claim 34, wherein the heater is heat trace.

36. The method for delivery of a gas according to claim 27, further comprising:

(d) integratably controlling the increasing the heat transfer rate and the superheating steps, such that pressure and temperature of the gas cylinder and the degree of superheating the gas withdrawn from the gas cylinder prior to any expansion of the gas are controlled.

37. The method for delivery of a gas according to claim 26, wherein the gas is selected from $NH_3$, $AsH_3$, $BCl_3$, $CO_2$, $Cl_2$, $SiH_2Cl_2$, $Si_2H_6$, HBr, HCl, HF, $N_2O$, $C_3F_8$, $SF_6$, $PH_3$ and $WF_6$.

38. The method for delivery of a gas according to claim 26, wherein the heat transfer rate is increased by forcing a heat transfer gas through one or more openings in the gas cabinet.

39. The method for delivery of a gas according to claim 38, wherein the heat transfer gas is air or an inert gas.

40. The method for delivery of a gas according to claim 38, wherein the one or more openings comprise one or more plenum plates or slits.

41. The method for delivery of a gas according to claim 40, wherein the step of increasing the heat transfer rate further comprises electrically controlling the temperature of the one or more plenum plates or slits to a value slightly higher than ambient temperature.

42. The method for delivery of a gas according to claim 26, wherein the step of increasing the heat transfer rate comprises directing an air flow substantially to a position on the cylinder corresponding to a liquid-vapor interface.

43. The method for delivery of a gas according to claim 26, wherein the step of increasing the heat transfer rate comprises providing one or more plenum plates or slits in the gas cabinet, the one or more plenum plates or slits further comprising fins for directing the flow of air.

44. The method for delivery of a gas according to claim 26, wherein the step of increasing the heat transfer rate comprises heating the cylinder with one or more radiant panel heater.

45. The method for delivery of a gas according to claim 26, wherein the step of increasing the heat transfer rate comprises heating the cylinder with a heater below the gas cylinder.

46. The method for delivery of a gas according to claim 45, wherein the heater disposed below the cylinder is a heated scale cover, the scale cover comprising an upper surface, a lower surface and a heating element disposed within a cavity formed between said upper and lower surfaces, the method further comprising measuring the weight of the cylinder with a scale.

47. The method for delivery of a gas according to claim 46, further comprising a step for controlling the heat output from the heated scale cover based on cylinder pressure and weight inputs.

* * * * *